US010168637B2

(12) United States Patent
Iwata

(10) Patent No.: US 10,168,637 B2
(45) Date of Patent: Jan. 1, 2019

(54) IMAGE FORMING APPARATUS OPTICAL SCANNING CONTROLLER, AND METHOD FOR CORRECTING EXPOSURE

(71) Applicant: Muneaki Iwata, Kanagawa (JP)

(72) Inventor: Muneaki Iwata, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/623,591

(22) Filed: Jun. 15, 2017

(65) Prior Publication Data

US 2018/0004115 A1 Jan. 4, 2018

(30) Foreign Application Priority Data

Jun. 30, 2016 (JP) ..... 2016-130873

(51) Int. Cl.
*G03G 15/00* (2006.01)
*G03G 15/043* (2006.01)

(52) U.S. Cl.
CPC ..... *G03G 15/043* (2013.01)

(58) Field of Classification Search
CPC ..... G03G 15/556; G03G 15/5058; G03G 2215/0132; G03G 2215/0161; G03G 2215/0164; G03G 15/043; G03G 15/5041; G03G 15/5054; G03G 13/04; G03G 15/04072
See application file for complete search history.

(56) References Cited

U.S. PATENT DOCUMENTS

2012/0099165 A1 4/2012 Omori et al.
2013/0243459 A1 9/2013 Omori et al.
2013/0302052 A1 11/2013 Iwata et al.
2014/0139605 A1 5/2014 Fujita et al.
2014/0301748 A1* 10/2014 Suzuki ..... G03G 15/5025 399/49
2015/0125171 A1 5/2015 Iwata et al.
2016/0223934 A1 8/2016 Watanabe et al.
2016/0234399 A1 8/2016 Omori et al.
(Continued)

FOREIGN PATENT DOCUMENTS

JP 2007-296782 11/2007
JP 2012-088522 5/2012
(Continued)

*Primary Examiner* — Ruifeng Pu
(74) *Attorney, Agent, or Firm* — Harness, Dickey & Pierce, P.L.C.

(57) ABSTRACT

An image forming apparatus includes a photoconductor, an optical scanner, a developing device, a density detector, and an exposure corrector. The photoconductor is rotatable in a direction of rotation. The optical scanner includes a light source, and drives the light source to form a latent image on a surface of the photoconductor. The developing device develops the latent image to form an image. The density detector detects variation in density of the image in the direction of rotation of the photoconductor. The exposure corrector generates exposure correction data for the optical scanner to reduce the variation in density. The exposure corrector adjusts output of the optical scanner according to the exposure correction data at a time different from a time when the exposure corrector updates the exposure correction data.

18 Claims, 28 Drawing Sheets

(56) References Cited

U.S. PATENT DOCUMENTS

| | | | |
|---|---|---|---|
| 2016/0247050 | A1 | 8/2016 | Fujita et al. |
| 2016/0274521 | A1 | 9/2016 | Iwata et al. |
| 2017/0017177 | A1 | 1/2017 | Iwata et al. |

FOREIGN PATENT DOCUMENTS

| | | |
|---|---|---|
| JP | 2013-235167 | 11/2013 |
| JP | 2016-173489 | 9/2016 |

* cited by examiner

IMAGE FORMING APPARATUS OPTICAL SCANNING CONTROLLER, AND METHOD FOR CORRECTING EXPOSURE

CROSS-REFERENCE TO RELATED APPLICATION

This patent application is based on and claims priority pursuant to 35 U.S.C. § 119(a) to Japanese Patent Application No. 2016-130873, filed on Jun. 30, 2016, in the Japan Patent Office, the entire disclosure of which is hereby incorporated by reference herein.

BACKGROUND

Technical Field

Embodiments of the present disclosure generally relate to an image forming apparatus, an optical scanning controller, and a method for correcting an exposure, and more particularly, to an image forming apparatus for forming an image on a recording medium, an optical scanning controller for controlling an optical scanner, and a method for correcting exposure in the image forming apparatus.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image bearer. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium bearing the toner image to fix the toner image onto the recording medium. Thus, an image is formed on the recording medium.

In such electrophotographic image forming apparatuses, an exposure device as the optical writer often includes a light source such as a light emitting diode (LED) to expose a photoconductor drum (i.e., photoconductor) to form a latent image thereon according to the image data. The developing device, which often includes a developing roller, supplies toner to a gap between the photoconductor drum and the developing roller so that the toner adheres to the photoconductor drum by static electricity. Thus, a toner image is formed on the photoconductor drum.

Since the photoconductor drum may not have a perfectly round cross-section and the photoconductor drum may have an eccentric axis, the gap between the photoconductor drum and a developing roller does not remain constant but instead periodically fluctuates as the photoconductor drum rotates. This fluctuation in the dimensions of the gap leads to unwanted variation in developing the image, for example, the amount of toner in the gap may fluctuate. As a consequence, cyclical variation in density of the output image may occur in a sub-scanning direction. In addition, other than the photoconductor drum, rotators of the image forming engine unit, such as the developing roller and a charging roller, may cause a similar variation in density of the output image.

To address these circumstances, the image forming apparatuses often correct exposure in a rotation period of the photoconductor drum, for example, to reduce such variation in density of the output image in the sub-scanning direction.

SUMMARY

In one embodiment of the present disclosure, a novel image forming apparatus is described that includes a photoconductor, an optical scanner, a developing device, a density detector, and an exposure corrector. The photoconductor is rotatable in a direction of rotation. The optical scanner includes a light source, and drives the light source to form a latent image on a surface of the photoconductor. The developing device develops the latent image to form an image. The density detector detects variation in density of the image in the direction of rotation of the photoconductor. The exposure corrector generates exposure correction data for the optical scanner to reduce the variation in density. The exposure corrector adjusts output of the optical scanner according to the exposure correction data at a time different from a time when the exposure corrector updates the exposure correction data.

Also described are a novel optical scanning controller for controlling an optical scanner, and a novel method for correcting an exposure in an image forming apparatus.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
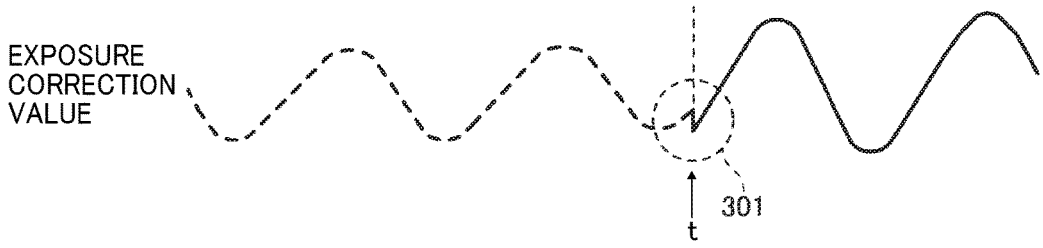
FIG. 1 is a schematic view of a comparative exposure correction value in a sub-scanning direction.

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

It is to be noted that, in the following description, suffixes K, C, M, and Y denote colors black, cyan, magenta, and yellow, respectively. To simplify the description, these suffixes are omitted unless necessary.

Initially with reference to FIG. 1, a general description is given of exposure correction in comparative image forming apparatuses.

The comparative image forming apparatuses often have side effects on images because the timing for correcting exposure is not considered. The side effects are unintended density changes that may occur when variation in density is reduced in a sub-scanning direction. For example, in a control operation executed by the comparative image forming apparatuses, an image forming engine forms a pattern for adjustment of image forming conditions between consecutive images of a print job, that is, between consecutive recording media. An electric potential sensor, a density sensor, and the like read the pattern. The readings are fed back to the image forming engine. The feedback is often referred to as calibration or adjustment of the image forming engine. Such control adjusts the conditions of operation of the image forming engine. At the same time, in association with changes in the conditions of operation of the image forming engine, an exposure correction value is adjusted to reduce the variation in density in the sub-scanning direction.

However, as the print job is under execution, a change of the exposure correction value during the print job generates a discontinuous point in the exposure for correction, causing the side effects on the images described above.

FIG. 1 is a schematic view of a comparative exposure correction value in the sub-scanning direction.

As illustrated in FIG. 1, the exposure is corrected with the exposure correction value that changes periodically. At a time "t", amplitude of the exposure for correction is changed, generating a discontinuous point or break 301 between the exposure correction value before change and the exposure correction value after change. Since such a discontinuous point of the exposure for correction may affect an image, comparative image forming apparatuses do not update the exposure correction value during execution of a print job. Therefore, even though feedback is performed to the image forming engine based on the pattern for adjustment of image forming conditions, a printing operation is halted to update the exposure correction value. As a consequence, productivity may decrease.

By contrast, an image forming apparatus according to embodiments of the present disclosure reduces such undesirable side effects of exposure correction.

Referring now to the drawings, embodiments of the present disclosure are described below.

Figure 2:
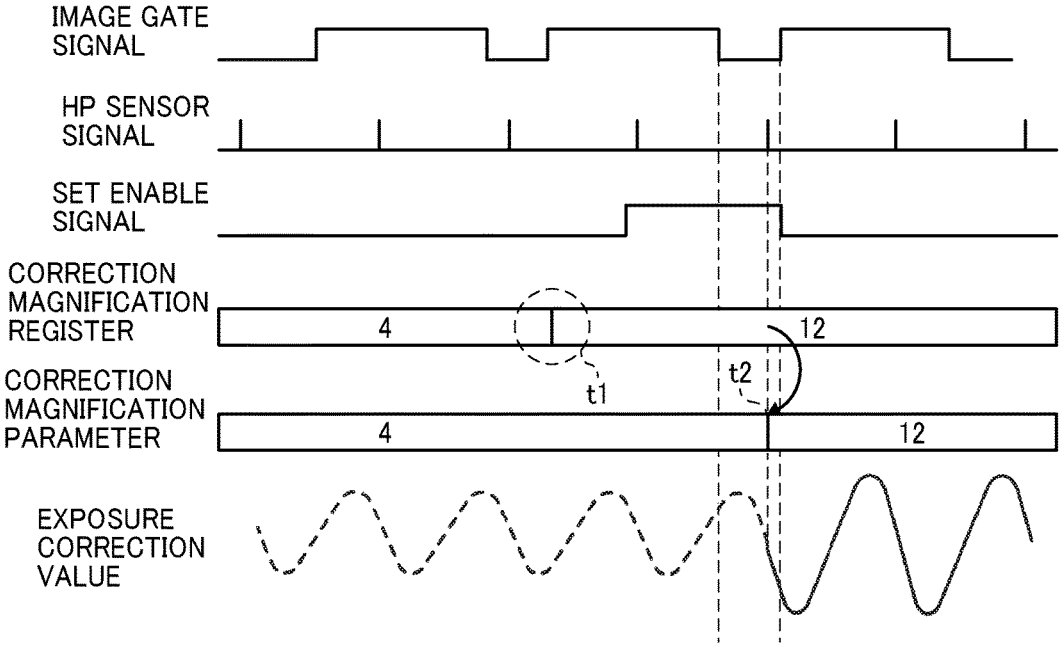
FIG. 2 is a timing chart of exposure correction according to an embodiment of the present disclosure.

Initially with reference to FIG. 2, a description is given of exposure correction according to one embodiment of the present disclosure.

FIG. 2 is a timing chart of the exposure correction.

When conditions of operation of an image forming engine change based on a pattern Pe for adjustment of image forming conditions, described below, as detected by a density detector 2245 (i.e., readings of the density detector 2245), an image forming apparatus 2000 of the present embodiment, illustrated in FIG. 3, changes a correction magnification while an image is not formed, in other words, between exposures. Thus, at a time "t1" in FIG. 2, a magnification value of an exposure correction value is set in a correction magnification register according to the conditions of operation of the image forming engine. That is, the value of the correction magnification register changes regardless of whether images are being formed or not. On the other hand, the correction magnification parameter is a magnification value of the exposure correction value referenced by an optical scanner. Only later, at a time "t2" in FIG. 2, does the correction magnification parameter refer to the value stored in the correction magnification register. Thus, the correction magnification parameter is updated at the time "t2", which is different from the time "t1" when the correction magnification register is changed.

In other words, as is apparent from FIG. 2, update timing is different between the correction magnification register and the correction magnification parameter. Since the correction magnification parameter is independent of the correction magnification register, the exposure correction value can be changed while images are not formed, in response to a change in conditions of operation of the image forming engine.

The following passage describes specific examples of the timing for reflecting the value of the correction magnification register to the correction magnification parameter.

The image forming apparatus 2000 of the present embodiment determines when to update the correction magnification parameter when, for example, the following conditions using three signals, preferably, are satisfied:

i) setting of registers is completed by a set enable signal asserted;

ii) images are not being formed because an image gate signal is enabled; and iii) an initial phase (i.e., home position) of the photoconductor drum in a direction of rotation is detected by an input of a home position (HP) sensor signal.

An update of the exposure correction value when the above-described conditions are satisfied protects image quality from side effects, because images are not formed when the exposure for correction discontinuously changes. Accordingly, when the pattern Pe for adjustment of image forming conditions (hereinafter referred to as the image forming condition adjustment pattern Pe) is formed between consecutive images of a print job, that is, between consecutive recording media, changing the conditions of operation of the image forming engine during the print job, the exposure correction value is changed immediately, leaving printing productivity unimpaired.

Figure 3:
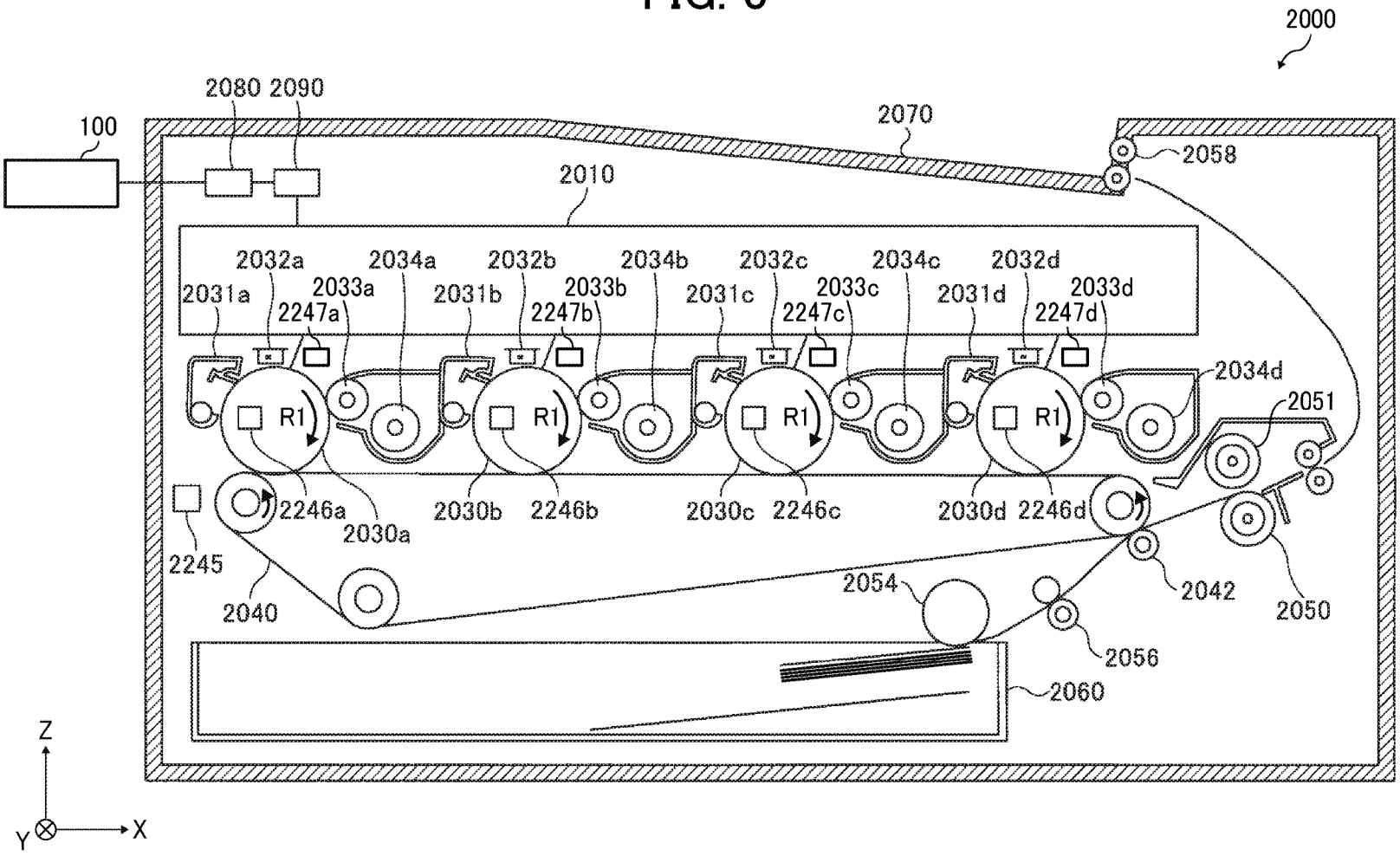
FIG. 3 is a schematic view of an image forming apparatus according to the embodiment.

Referring now to FIG. 3, a description is given of a configuration of the image forming apparatus 2000.

FIG. 3 is a schematic view of the image forming apparatus 2000.

In the present embodiment, the image forming apparatus 2000 is a color printer employing a tandem system in which four image forming devices are aligned to form toner images of black (K), cyan (C), magenta (M), and yellow (Y), respectively. The toner images are superimposed one atop another, forming a full-color toner image. The image forming apparatus 2000 includes, e.g., an optical scanner 2010, four photoconductor drums 2030*a*, 2030*b*, 2030*c*, and 2030*d*, four cleaners 2031*a*, 2031*b*, 2031*c*, and 2031*d*, four chargers 2032*a*, 2032*b*, 2032*c*, and 2032*d*, four developing rollers 2033*a*, 2033*b*, 2033*c*, and 2033*d*, and four toner cartridges 2034*a*, 2034*b*, 2034*c*, and 2034*d*. The optical scanner 2010 serves as an exposure device. The four photoconductor drums 2030*a*, 2030*b*, 2030*c*, and 2030*d* serve as photoconductors rotatable in a direction of rotation R1 as illustrated in FIG. 3.

The image forming apparatus 2000 further includes a transfer belt 2040, a transfer roller 2042, a fixing roller 2050, a pressure roller 2051, a sheet feeding roller 2054, a registration roller pair 2056, a sheet ejection roller pair 2058, a sheet tray 2060, an output tray 2070, a communication controller 2080, and the density detector 2245. The image forming apparatus 2000 further includes four home position sensors 2246*a*, 2246*b*, 2246*c*, and 2246*d*, and a printer controller 2090. The four home position sensors 2246*a*, 2246*b*, 2246*c*, and 2246*d* detect rotation of the four photoconductor drums 2030*a*, 2030*b*, 2030*c*, and 2030*d*, respectively. The printer controller 2090 generally controls components described above.

Hereinafter, the four photoconductor drums 2030*a*, 2030*b*, 2030*c*, and 2030*d* may be collectively referred to as the photoconductor drums 2030 unless otherwise required. Any one of the four photoconductor drums 2030*a*, 2030*b*, 2030*c*, and 2030*d* may be simply referred to as the photoconductor drum 2030 unless otherwise required. Similarly, the four chargers 2032*a*, 2032*b*, 2032*c*, and 2032*d* may be collectively referred to as the chargers 2032 unless otherwise required. Any one of the four chargers 2032*a*, 2032*b*, 2032*c*, and 2032*d* may be simply referred to as the charger 2032 unless otherwise required. Similarly, the four developing rollers 2033*a*, 2033*b*, 2033*c*, and 2033*d* may be collectively referred to as the developing rollers 2033 unless otherwise required. Any one of the four developing rollers 2033*a*, 2033*b*, 2033*c*, and 2033*d* may be simply referred to as the developing roller 2033 unless otherwise required.

The communication controller 2080 controls bidirectional communication with an upstream device 100 such as a personal computer (PC) through a network or the like. The communication controller 2080 is, e.g., a network card such as Ethernet (registered trademark).

The printer controller 2090 is, e.g., an information processing apparatus or a microcomputer. The printer controller 2090 includes, e.g., a central processing unit (CPU), a read only memory (ROM), a random access memory (RAM), and an analog-to-digital (A/D) converter. The ROM holds a program described by CPU-readable codes and various kinds of data that is used for execution of the program. The RAM is a working memory. The A/D converter converts analog data to digital data. The printer controller 2090 controls the components of the image forming apparatus 2000 in response to a request from the upstream device 100 to execute a print job while transmitting image data (i.e., image information) included in the print job to the optical scanner 2010.

The photoconductor drum 2030*a*, the charger 2032*a*, the developing roller 2033*a*, the toner cartridge 2034*a*, and the cleaner 2031*a* operate as a set of devices to form a single-color toner image, in the present embodiment, a black toner image. Thus, the set of devices to form a single-color toner image is herein referred to as an image forming station. Hereinafter, the image forming station to form the black toner image may be simply referred to as a station K.

Similarly, in the present embodiment, the photoconductor drum 2030*b*, the charger 2032*b*, the developing roller 2033*b*, the toner cartridge 2034*b*, and the cleaner 2031*b* operate as a set of devices to form a cyan toner image. Hereinafter, the set of devices (i.e., image forming station) to form the cyan toner image may be simply referred to as a station C.

Similarly, in the present embodiment, the photoconductor drum 2030*c*, the charger 2032*c*, the developing roller 2033*c*, the toner cartridge 2034*c*, and the cleaner 2031*c* operate as a set of devices to form a magenta toner image. Hereinafter, the set of devices (i.e., image forming station) to form the magenta toner image may be simply referred to as a station M.

Similarly, in the present embodiment, the photoconductor drum 2030*d*, the charger 2032*d*, the developing roller 2033*d*, the toner cartridge 2034*d*, and the cleaner 2031*d* operate as a set of devices to form a yellow toner image. Hereinafter, the set of devices (i.e., image forming station) to form the yellow toner image may be simply referred to as a station Y.

Hereinafter, the four stations K, C, M, and Y may be collectively referred to as the stations unless otherwise required. Any one of the four K, C, M, and Y may be simply referred to as "the station" unless otherwise required.

The photoconductor drum 2030 has a photosensitive surface layer. The optical scanner 2010 irradiates the surface of the photoconductor drum 2030 with light. In other words, the optical scanner 2010 scans the surface of the photoconductor drum 2030. A rotation mechanism rotates the photoconductor drum 2030 clockwise in the direction of rotation R1 as illustrated in FIG. 3.

In FIG. 3, in three dimensional orthogonal coordinates XYZ, a direction of an X-axis (hereinafter referred to as a direction X) is a direction in which the four photoconductor drums 2030 are aligned. A direction of a Y-axis (hereinafter referred to as a direction Y) is a longitudinal direction of the photoconductor drums 2030.

The charger 2032 uniformly charges the surface of the photoconductor drum 2030. According to image data transmitted from the upstream device 100, the optical scanner 2010 irradiates the charged surface of the photoconductor drum 2030 with light. Specifically, according to black image data, cyan image data, magenta image data, and yellow image data, the optical scanner 2010 irradiates the charged surface of the photoconductor drums 2030*a*, 2030*b*, 2030*c*, and 2030*d* with light beams modulated for black, cyan, magenta, and yellow, respectively. Irradiation of the surface of the photoconductor drum 2030 eliminates the charge of an irradiated portion on the surface of the photoconductor drum 2030, forming a latent image thereon according to the image data. As the photoconductor drum 2030 rotates, the latent image thus formed on the surface of the photoconductor drum 2030 moves to a position where the latent image faces the developing roller 2033. A detailed description of a configuration of the optical scanner 2010 is deferred.

On the surface of the photoconductor drum 2030, a writing area in which the latent image is formed according to the image data may be referred to as an effective scanning area, an image forming area, an effective image area, or the like.

The toner cartridge 2034*a* accommodates black toner to supply the black toner to the developing roller 2033*a*. The toner cartridge 2034*b* accommodates cyan toner to supply the cyan toner to the developing roller 2033*b*. The toner cartridge 2034*c* accommodates magenta toner to supply the magenta toner to the developing roller 2033*c*. The toner cartridge 2034*d* accommodates yellow toner to supply the yellow toner to the developing roller 2033*d*.

As the developing roller 2033 rotates, the toner supplied from the toner cartridge 2034 is thinly and uniformly applied to the surface of the developing roller 2033. When the toner on the surface of the developing roller 2033 contacts the surface of the photoconductor drum 2030, the toner moves and adheres to the irradiated portion on the surface of the photoconductor drum 2030. In other words, the developing roller 2033 allows the toner to adhere to the latent image formed on the surface of the photoconductor drum 2030, rendering the latent image visible as a toner image. Thus, the toner image is formed on the surface of the photoconductor drum 2030. As the photoconductor drum 2030 rotates, the toner image is transferred onto the transfer belt 2040 from the photoconductor drum 2030.

In a primary transfer process, black, cyan, magenta, and yellow toner images are timed to be transferred sequentially on the transfer belt 2040 such that the black, cyan, magenta, and yellow toner images are superimposed one atop another on the transfer belt 2040. Thus, a composite color toner image is formed on the transfer belt 2040.

In a lower portion of the image forming apparatus 2000 is the sheet tray 2060 that accommodates recording media. The sheet feeding roller 2054 is disposed near the sheet tray 2060. The sheet feeding roller 2054 picks up the recording media one at a time from the sheet tray 2060 to feed the recording medium to the registration roller pair 2056. Activation of the registration roller pair 2056 is timed to convey the recording medium to an area of contact herein referred to as a secondary transfer nip between the transfer belt 2040 and the transfer roller 2042 such that the recording medium meets the color toner image formed on the transfer belt 2040 at the secondary transfer nip. Accordingly, the color toner image is transferred onto the recording medium from the transfer belt 2040 at the secondary transfer nip. The recording medium bearing the color toner image is then conveyed to an area of contact (herein referred to as a fixing nip) between the fixing roller 2050 and the pressure roller 2051.

The recording medium bearing the color toner image receives heat and pressure at the fixing nip. Accordingly, the color toner image is fixed onto the recording medium. Thereafter, the recording medium is conveyed to the sheet ejection roller pair 2058. The sheet ejection roller pair 2058 ejects the recording medium onto the output tray 2070. Thus, recording media rest on the output tray 2070 one by one.

The cleaner 2031 removes residual toner from the surface of the photoconductor drum 2030. The residual toner is toner which has failed to be transferred onto the transfer belt 2040 and therefore remains on the surface of the photoconductor drum 2030. Thus, the cleaner 2031 cleans the surface of the photoconductor drum 2030. As the photoconductor drum 2030 rotates, the cleaned surface of the photoconductor drum 2030 returns to a position where the surface of the photoconductor drum 2030 faces the charger 2032.

The density detector 2245 is disposed on a negative (−) X side of the transfer belt 2040, that is, on a negative (−) side in the direction X from where the transfer belt 2040 is situated. A detailed description of the density detector 2245 is deferred with reference to FIGS. 4 and 5.

The home position sensor 2246*a* detects a home position of rotation of the photoconductor drum 2030*a*. The home position sensor 2246*b* detects a home position of rotation of the photoconductor drum 2030*b*. The home position sensor 2246*c* detects a home position of rotation of the photoconductor drum 2030*c*. The home position sensor 2246*d* detects a home position of rotation of the photoconductor drum 2030*d*.

It is to be noted that four electric potential sensors 2247*a*, 2247*b*, 2247*c*, and 2247*d* are disposed opposite the four photoconductor drums 2030*a*, 2030*b*, 2030*c*, and 2030*d*, respectively. The electric potential sensors 2247*a*, 2247*b*, 2247*c*, and 2247*d* detect a surface potential of the photoconductor drums 2030*a*, 2030*b*, 2030*c*, and 2030*d*, respectively.

Figure 4:
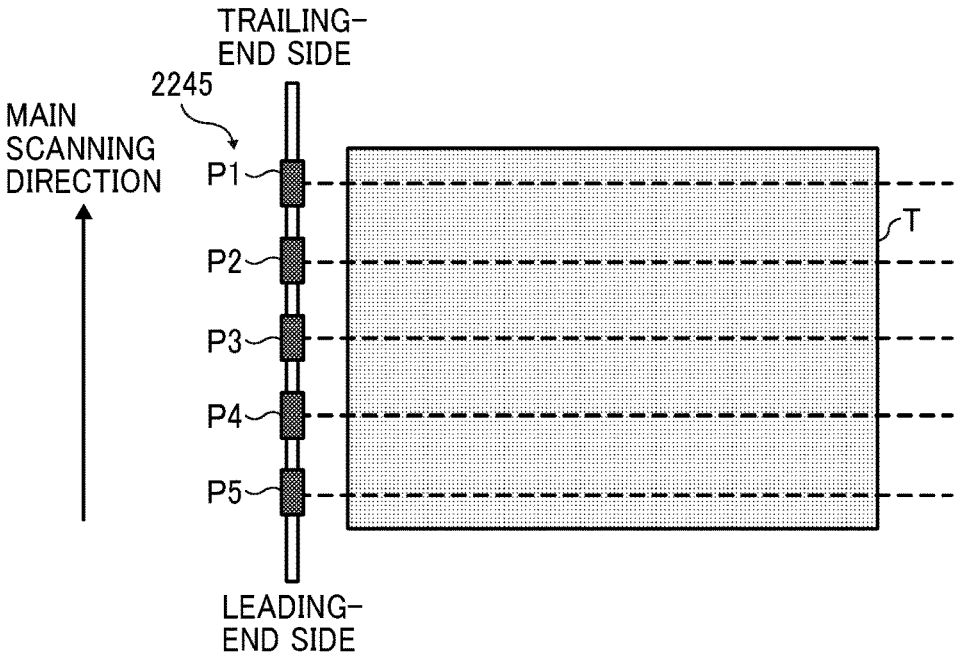
FIG. 4 is a view of a density detector incorporated in the image forming apparatus of FIG. 3, illustrating a location and a configuration of the density detector.

Referring now to FIG. 4, a description is given of a location and a configuration of the density detector 2245.

FIG. 4 is a view of the density detector 2245, illustrating a location and a configuration of the density detector 2245.

For example, as illustrated in FIG. 4, the density detector 2245 includes five optical sensors P1, P2, P3, P4, and P5. Hereinafter, the five optical sensors P1 through P5 may be collectively referred to as the optical sensors P unless otherwise required. The optical sensors P1 through P5 are aligned in line in a main scanning direction, facing the transfer belt 2040. As the transfer belt 2040 rotates, the optical sensors P1 through P5 detect density of toner T of a pattern for density detection formed on the transfer belt 2040 in the sub-scanning direction. It is to be noted that the optical sensors P1 through P5 cover the effective image area in the main scanning direction.

The number of the optical sensors P is not limited to five, provided that the density detector 2245 includes one or more optical sensors P. For example, the density detector 2245 may include six or more optical sensors P. An increased number of optical sensors P aligned in the main scanning direction detect variation in density more precisely in the sub-scanning direction. Although FIG. 4 illustrates the toner T of the pattern covering an entire surface of the transfer belt 2040, the pattern need not be formed over the entire surface of the transfer belt 2040, provided that the pattern is under the optical sensors P1 through P5, facing the optical sensors P1 through P5.

Figure 5:
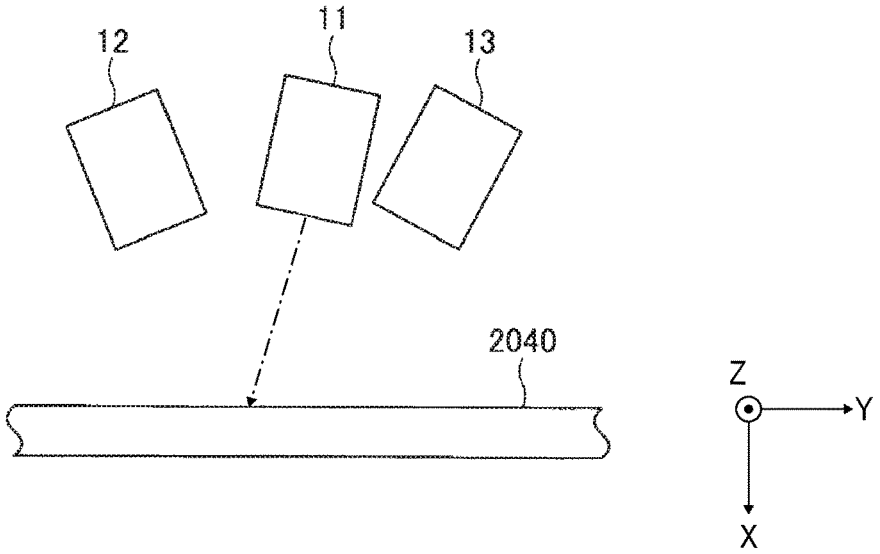
FIG. 5 is a view of a transfer belt incorporated in the image forming apparatus of FIG. 3 and an optical sensor incorporated in the density detector of FIG. 4, particularly illustrating a configuration of the optical sensor.

Referring now to FIG. 5, a description is given of a configuration of each of the optical sensors P1 through P5.

FIG. 5 is a view of the transfer belt 2040 and one of the optical sensors P, particularly illustrating the configuration of the one of the optical sensors P.

For example, as illustrated in FIG. 5, each of the optical sensors P1 through P5 includes a light emitting diode (LED) 11, a specularly reflected light receiving device 12, and a diffusely reflected light receiving device 13. The LED 11 emits light toward the transfer belt 2040. The light emitted by the LED 11 may be subjected to detection and hereinafter referred to as detection light. The specularly reflected light receiving device 12 receives light specularly reflected from a toner pad on the transfer belt 2040. If there is no toner on the transfer belt 2040, the specularly reflected light receiving device 12 receives light specularly reflected from the transfer belt 2040. The diffusely reflected light receiving device 13 receives light diffusely reflected from the toner pad on the transfer belt 2040. If there is no toner on the transfer belt 2040, the diffusely reflected light receiving device 13 receives light diffusely reflected from the transfer belt 2040. Each of the specularly reflected light receiving device 12 and the diffusely reflected light receiving device 13 outputs a signal (i.e., photoelectric conversion signal) corresponding to an amount of light thus received.

Since the transfer belt 2040 specularly reflects the detection light, the specularly reflected light decreases when the detection light is reflected from toner of cyan, magenta, and yellow. On the other hand, the diffusely reflected light increases because the detection light is diffusely reflected from the toner of cyan, magenta, and yellow. The intensities of specular reflection and diffuse reflection depend on the color of toner. Therefore, if a relation between density and the intensities of specularly reflected light and diffusely reflected light is obtained for each color, the optical sensors P1 through P5 obtain the density from the photoelectric conversion signal. Relatedly, black toner barely reflects the detection light specularly. Therefore, the density is obtained from the intensity of the diffusely reflected light.

Referring now to FIGS. 6 through 9, a description is given of a configuration of the optical scanner 2010.

Figure 6:
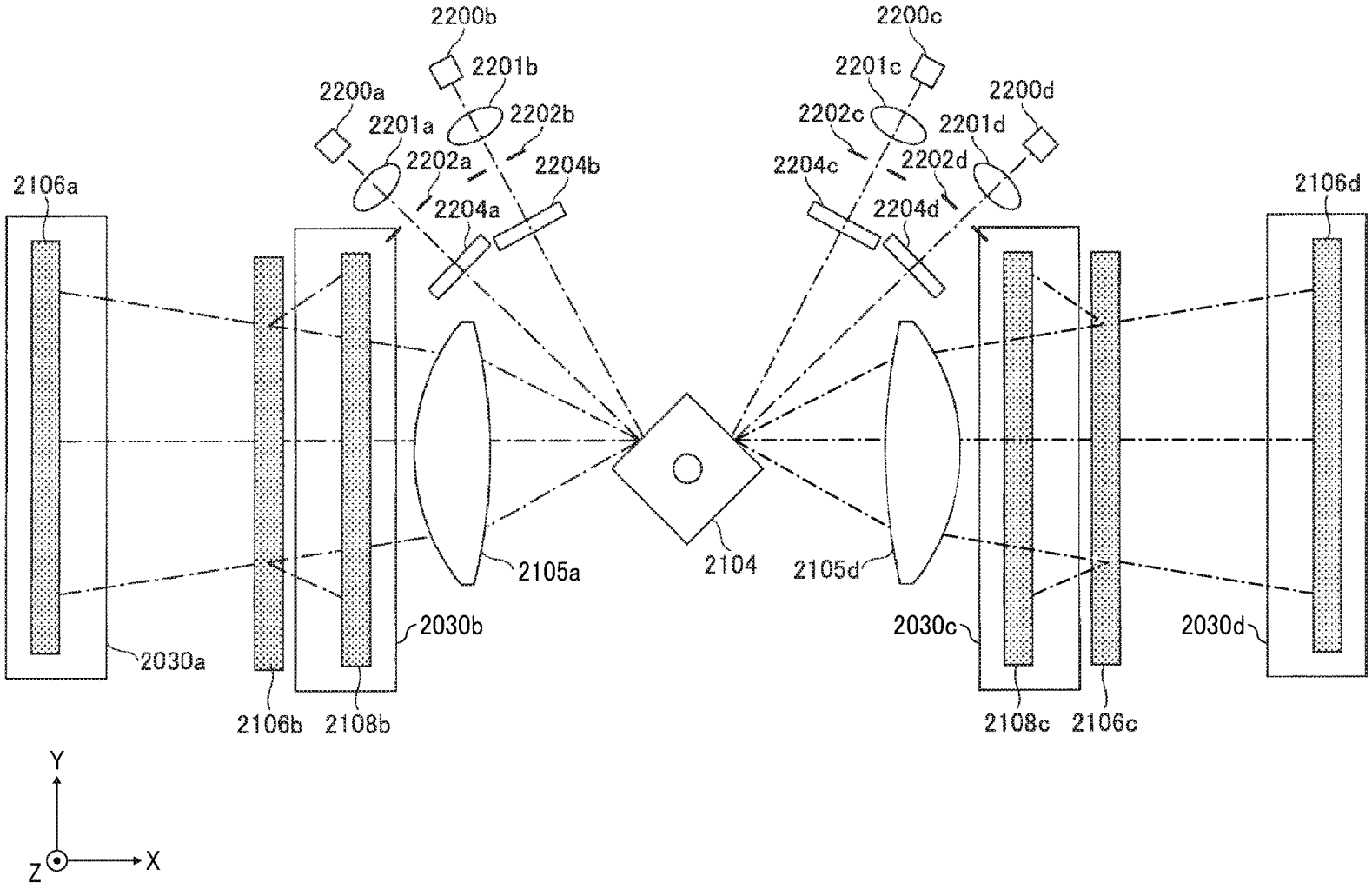
FIG. 6 is a top view of an optical scanner incorporated in the image forming apparatus of FIG. 3.
Figure 7:
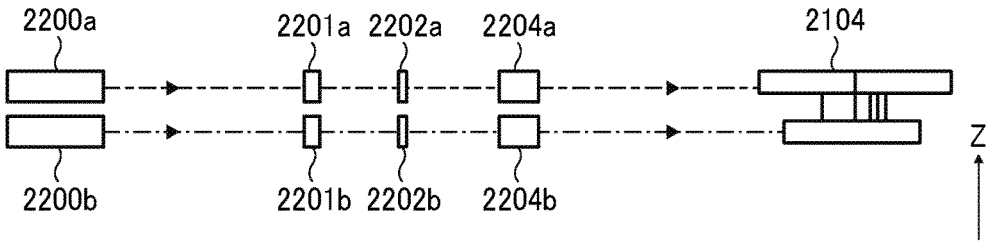
FIG. 7 is a partial side view of the optical scanner of FIG. 6, illustrating a configuration from light sources to a polygon mirror on a −X side.
Figure 8:
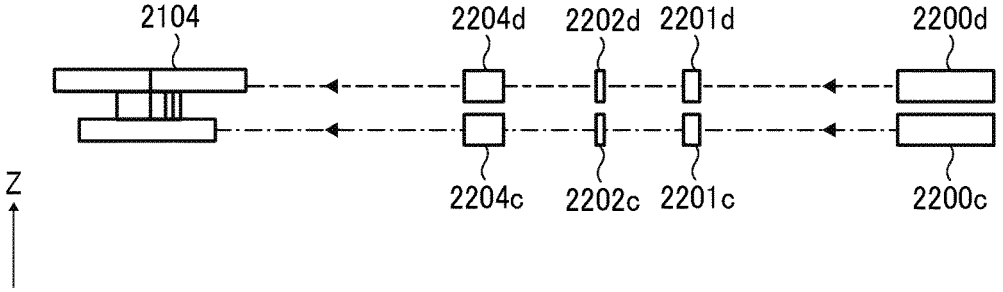
FIG. 8 is a partial side view of the optical scanner of FIG. 6, illustrating a configuration from other light sources to the polygon mirror on a +X side.
Figure 9:
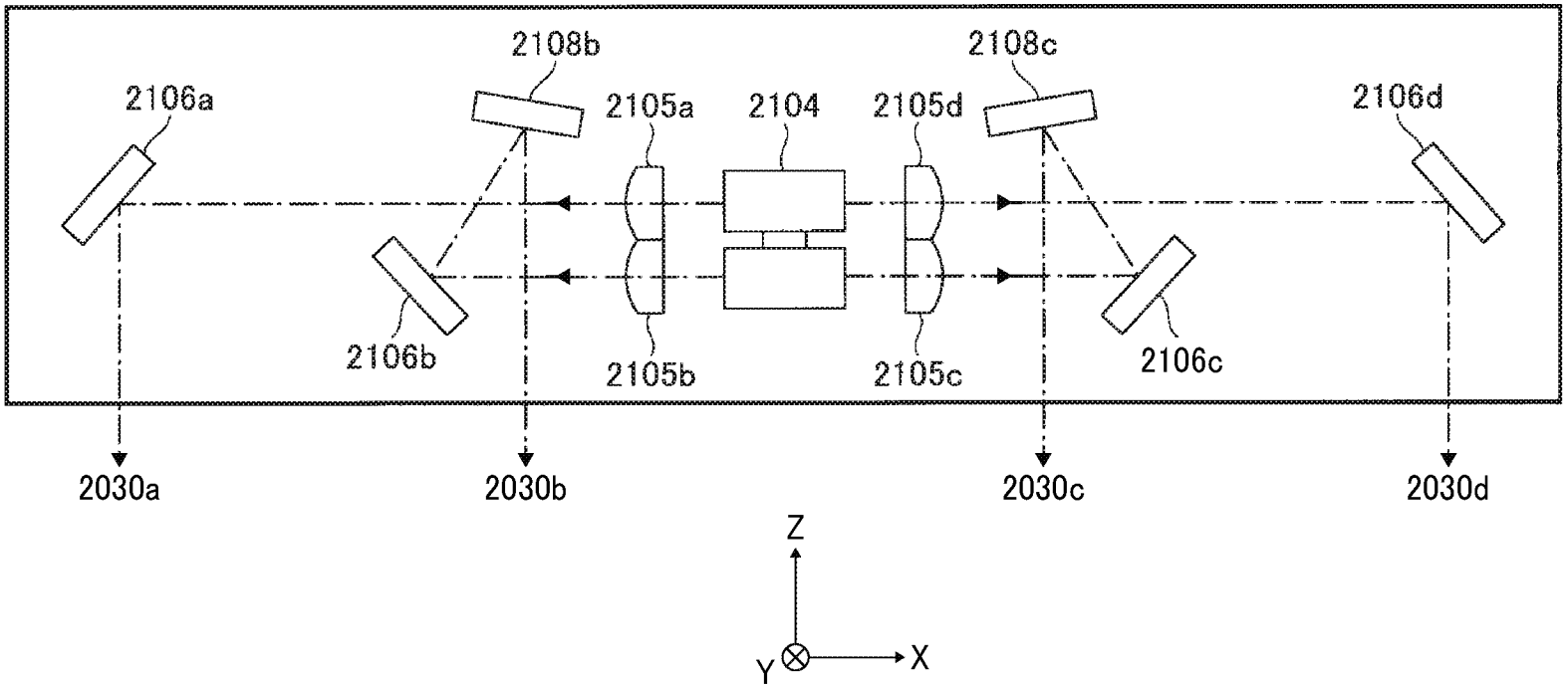
FIG. 9 is a partial side view of the optical scanner of FIG. 6, illustrating a configuration from the polygon mirror to photoconductor drums.

FIG. 6 is a top view of the optical scanner 2010. FIG. 7 is a partial side view of the optical scanner 2010, illustrating a configuration from light sources 2200*a* and 2200*b* to a polygon mirror 2104 on the −X side, that is, on the negative (−) side in the direction X from where the polygon mirror 2104 is situated. FIG. 8 is a partial side view of the optical scanner 2010, illustrating a configuration from light sources 2200*c* and 2200*d* to the polygon mirror 2104 on a positive (+) X side, that is, on a positive (+) side in the direction X from where the polygon mirror 2104 is situated. FIG. 9 is a partial side view of the optical scanner 2010, illustrating a configuration from the polygon mirror 2104 to the photoconductor drums 2030*a*, 2030*b*, 2030*c*, and 2030*d*.

The optical scanner 2010 includes, e.g., the four light sources 2200*a*, 2200*b*, 2200*c*, and 2200*d*, four coupling lenses 2201*a*, 2201*b*, 2201*c*, and 2201*d*, four aperture plates 2202*a*, 2202*b*, 2202*c*, and 2202*d*, four cylindrical lenses 2204*a*, 2204*b*, 2204*c*, and 2204*d*, the polygon mirror 2104, four scanning lenses 2105*a*, 2105*b*, 2105*c*, and 2105*d*, and six deflection mirrors 2106*a*, 2106*b*, 2106*c*, 2106*d*, 2108*b*, and 2108*c*.

The foregoing optical elements are installed at predetermined positions in an optical housing. Hereinafter, the four light sources 2200*a*, 2200*b*, 2200*c*, and 2200*d* may be collectively referred to as the light sources 2200 unless otherwise required. Any one of the four light sources 2200*a*, 2200*b*, 2200*c*, and 2200*d* may be simply referred to as the light source 2200 unless otherwise required.

The light source 2200 includes, e.g., a surface emitting laser array, in which a plurality of light emitting units (e.g., 40 light emitting units) are arranged in a two-dimensional array. The light emitting units of the surface emitting laser array are disposed such that the light emitting units are arrayed at equal intervals when all the light emitting units are orthogonally projected along a virtual line that extends in a direction corresponding to the sub-scanning direction, for example. That is, the light emitting units are separated from each other at least in the direction corresponding to the sub-scanning direction. Hereinafter, a distance between centers of two of the light emitting units may be referred to as an interval between the light emitting units.

The coupling lens 2201*a* is disposed on an optical path of a luminous flux emitted from the light source 2200*a* to turn the luminous flux into substantially parallel luminous flux. The coupling lens 2201*b* is disposed on an optical path of a luminous flux emitted from the light source 2200*b* to turn the luminous flux into substantially parallel luminous flux. The coupling lens 22011*c* is disposed on an optical path of a luminous flux emitted from the light source 2200*c* to turn the luminous flux into substantially parallel luminous flux. The coupling lens 2201*d* is disposed on an optical path of a luminous flux emitted from the light source 2200*d* to turn the luminous flux into substantially parallel luminous flux.

The aperture plate 2202*a* has an opening to limit the amount of luminous flux passing through the coupling lens 2201*a*. The aperture plate 2202*b* has an opening to limit the amount of luminous flux passing through the coupling lens 2201*b*. The aperture plate 2202*c* has an opening to limit the amount of luminous flux passing through the coupling lens 2201*c*. The aperture plate 2202*d* has an opening to limit the amount of luminous flux passing through the coupling lens 2201*d*.

The cylindrical lens 2204*a* images the luminous flux passing through the opening of the aperture plate 2202*a* on a reflective surface of the polygon mirror 2104 or on a nearby area thereof, in the direction Z. The cylindrical lens 2204*b* images the luminous flux passing through the opening of the aperture plate 2202*b* on a reflective surface of the polygon mirror 2104 or on a nearby area thereof, in the direction Z. The cylindrical lens 2204*c* images the luminous flux passing through the opening of the aperture plate 2202*c* on a reflective surface of the polygon mirror 2104 or on a nearby area thereof, in the direction Z. The cylindrical lens 2204*d* images the luminous flux passing through the opening of the aperture plate 2202*d* on a reflective surface of the polygon mirror 2104 or on a nearby area thereof, in the direction Z.

The coupling lens 2201*a*, the aperture plate 2202*a*, and the cylindrical lens 2204*a* construct a pre-deflector optical system for the station K. The coupling lens 2201*b*, the aperture plate 2202*b*, and the cylindrical lens 2204*b* construct a pre-deflector optical system for the station C. The coupling lens 2201*c*, the aperture plate 2202*c*, and the cylindrical lens 2204*c* construct a pre-deflector optical system for the station M. The coupling lens 2201*d*, the aperture plate 2202*d*, and the cylindrical lens 2204*d* construct a pre-deflector optical system for the station Y.

The polygon mirror 2104 has a two-story structure, each having a four-sided mirror, rotatable about an axis parallel to a Z-axis. The four-sided mirror includes four deflection surfaces. The four-sided mirror on a first story of the polygon mirror 2104 deflects the luminous flux from the cylindrical lens 2204*b* and the luminous flux from the cylindrical lens 2204*c*. On the other hand, the four-sided mirror on a second story of the polygon mirror 2104 deflects the luminous flux from the cylindrical lens 2204*a* and the luminous flux from the cylindrical lens 2204*d*.

The polygon mirror 2104 deflects the luminous flux from the cylindrical lens 2204*a* and the luminous flux from the cylindrical lens 2204*b* to the −X side, that is, in a negative (−) direction of the X-axis from where the polygon mirror 2104 is situated. On the other hand, the polygon mirror 2104 deflects the luminous flux from the cylindrical lens 2204*c* and the luminous flux from the cylindrical lens 2204*d* to the +X side, that is, in a positive (+) direction of the X-axis from where the polygon mirror 2104 is situated.

The scanning lens 2105 has optical power to condense the luminous flux to the photoconductor drum 2030 or to a nearby area thereof. The scanning lens 2105 also has optical power to move an optical spot on the photoconductor drum 2030 at a constant speed in the main scanning direction in accordance with rotation of the polygon mirror 2104.

The scanning lenses 2105*a* and 2105*b* are disposed on the X side of the polygon mirror 2104, that is, on the negative (−) side of the X-axis from where the polygon mirror 2104 is situated. On the other hand, the scanning lenses 2105*c* and 2105*d* are disposed on the +X side of the polygon mirror 2104, that is, on the positive (+) side of the X-axis from where the polygon mirror 2104 is situated.

The scanning lens 2105*a* rests on the scanning lens 2105*b* in the direction Z. The scanning lens 2105*b* is disposed opposite the four-sided mirror on the first story of the polygon mirror 2104. On the other hand, the scanning lens 2105*a* is disposed opposite the four-sided mirror on the second story of the polygon mirror 2104. Similarly, the scanning lens 2105*d* rests on the scanning lens 2105*c* in the direction Z. The scanning lens 2105*c* is disposed opposite the four-sided mirror on the first story of the polygon mirror 2104. On the other hand, the scanning lens 2105*d* is disposed opposite the four-sided mirror on the second story of the polygon mirror 2104.

The luminous flux passing through the cylindrical lens 2204*a* and deflected by the polygon mirror 2104 reaches the photoconductor drum 2030*a* via the scanning lens 2105*a* and the deflection mirror 2106*a*, to form an optical spot on the photoconductor drum 2030*a*. As the polygon mirror 2104 rotates, the optical spot moves in the longitudinal direction of the photoconductor drum 2030*a*. That is, the optical spot is directed on the photoconductor drum 2030*a*. The direction in which the optical spot moves is the "main scanning direction" on the photoconductor drum 2030*a*. The direction of rotation of the photoconductor drum 2030*a* (i.e., direction of rotation R1 illustrated in FIG. 3) is the "sub-scanning direction" on the photoconductor drum 2030*a*.

Similarly, the luminous flux passing through the cylindrical lens 2204*b* and deflected by the polygon mirror 2104 reaches the photoconductor drum 2030*b* via the scanning lens 2105*b* and the deflection mirrors 2106*b* and 2108*b*, to form an optical spot on the photoconductor drum 2030*b*. As the polygon mirror 2104 rotates, the optical spot moves in the longitudinal direction of the photoconductor drum 2030*b*. That is, the optical spot is directed on the photoconductor drum 2030*b*. The direction in which the optical spot moves is the "main scanning direction" on the photoconductor drum 2030*b*. The direction of rotation of the photoconductor drum 2030*b* (i.e., direction of rotation R1 illustrated in FIG. 3) is the "sub-scanning direction" on the photoconductor drum 2030*b*.

Similarly, the luminous flux passing through the cylindrical lens 2204*c* and deflected by the polygon mirror 2104 reaches the photoconductor drum 2030*c* via the scanning lens 2105*c* and the deflection mirrors 2106*c* and 2108*c*, to form an optical spot on the photoconductor drum 2030*c*. As the polygon mirror 2104 rotates, the optical spot moves in the longitudinal direction of the photoconductor drum 2030*c*. That is, the optical spat is directed on the photoconductor drum 2030*c*. The direction in which the optical spot moves is the "main scanning direction" on the photoconductor drum 2030*c*. The direction of rotation of the photoconductor drum 2030*c* (i.e., direction of rotation R1 illustrated in FIG. 3) is the "sub-scanning direction" on the photoconductor drum 2030*c*.

Similarly, the luminous flux passing through the cylindrical lens 2204*d* and deflected by the polygon mirror 2104 reaches the photoconductor drum 2030*d* via the scanning lens 2105*d* and the deflection mirror 2106*d*, to form an optical spot on the photoconductor drum 2030*d*. As the polygon mirror 2104 rotates, the optical spot moves in the longitudinal direction of the photoconductor drum 2030*d*. That is, the optical spot is directed on the photoconductor drum 2030*d*. The direction in which the optical spot moves is the "main scanning direction" on the photoconductor drum 2030*d*. The direction of rotation of the photoconductor drum 2030*c* (i.e., direction of rotation R1 illustrated in FIG. 3) is the "sub-scanning direction" on the photoconductor drum 2030*d*.

The deflection mirrors 2106 and 2108 are disposed such that the optical paths have identical lengths from the polygon mirror 2104 to the respective photoconductor drums 2030. In addition, the deflection mirrors 2106 and 2018 are disposed such that the luminous fluxes enter identical positions on the respective photoconductor drums 2030 at identical angles of incidence.

Optical systems disposed on the optical paths between the polygon mirror 2104 and the respective photoconductor drums 2030 are referred to as scanning optical systems. For example, the scanning optical system for the station K includes, e.g., the scanning lens 2105*a* and the deflection mirror 2106*a*. The scanning optical system for the station C includes, e.g., the scanning lens 2105*b* and the deflection mirrors 2106*b* and 2108*b*. The scanning optical system for the station M includes, e.g., the scanning lens 2105*c* and the deflection mirrors 2106*c* and 2108*c*. The scanning optical system for the station Y includes, e.g., the scanning lens 2105*d* and the deflection mirror 2106*d*. In the present embodiment, each of the scanning optical systems includes a single scanning lens 2105. Alternatively, each of the scanning optical systems may include a plurality of scanning lenses 2105.

Figure 10:
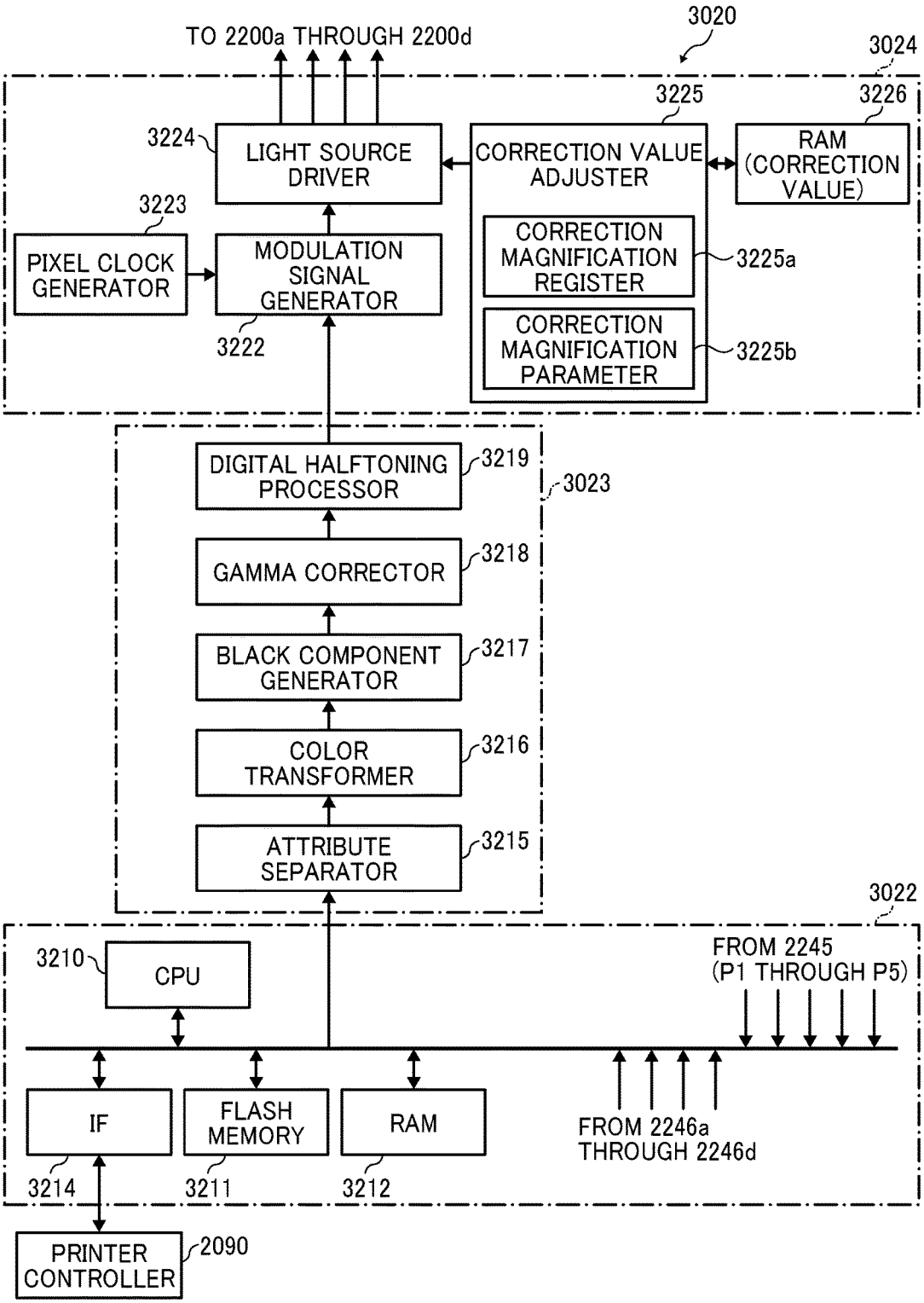
FIG. 10 is a block diagram illustrating a hardware structure of an optical scanning controller incorporated in the image forming apparatus of FIG. 3.

Referring now to FIG. 10, a description is given of an optical scanning controller 3020.

The optical scanning controller 3020 controls the optical scanner 2010 described above. For example, the optical scanning controller 3020 may be included in the printer controller 2090. Alternatively, the optical scanning controller 3020 may be disposed inside the optical scanner 2010. The location of the optical scanning controller 3020 is thus not particularly limited.

FIG. 10 is a block diagram illustrating a hardware structure of the optical scanning controller 3020.

The optical scanning controller 3020 includes an interface unit 3022, an image processing unit 3023, and a driving control unit 3024.

The interface unit 3022 receives red-green-blue (RGB) image data (i.e., input image data) from the upstream device 100 via the communication controller 2080 (as illustrated in FIG. 3) and the printer controller 2090. The interface unit 3022 transfers the RGB image data (i.e., input image data) to the image processing unit 3023 disposed downstream from the interface unit 3022 in a data transfer or transmission direction.

The image processing unit 3023 serves as an image processor. The image processing unit 3023 acquires the image data from the interface unit 3022. The image processing unit 3023 converts the image data into color image data appropriate for the printing system employed. For example, the image processing unit 3023 converts the RGB image data into image data for a tandem system, that is, image data of cyan, magenta, yellow, and black (hereinafter referred to as CMYK image data). In addition to the conversion of the image data, the image processing unit 3023 performs various kinds of image processing on the image data. The image processing unit 3023 transmits the image data thus converted to the driving control unit 3024.

The driving control unit 3024 modulates the image data transmitted from the image processing unit 3023 into a clock signal indicating when a pixel emits light, thereby generating an independent modulation signal for each color. The driving control unit 3024 drives each of the light sources 2200*a*, 2200*b*, 2200*c*, and 2200*d* to emit light according to the modulation signal for each color.

The driving control unit 3024 is, e.g., a single, integrated device as one chip disposed near the light sources 2200*a*, 2200*b*, 2200*c*, and 2200*d*, facilitating installation and removal of the driving control unit 3024 while enhancing maintenance and replacement. The image processing unit 3023 and the interface unit 3022 are disposed farther from the light sources 2200*a*, 2200*b*, 2200*c*, and 2200*d* than the driving control unit 3024 is. A cable couples the image processing unit 3023 to the driving control unit 3024.

The optical scanner 2010 configured as described above forms a latent image on the surface of the photoconductor drum 2030 with the light source 2200 that emits light according to the image data. Now, a detailed description is given of each of the units of the optical scanning controller 3020 described above.

The interface unit 3022 includes, a flash memory 3211, a random access memory (RAM) 3212, an interface (IF) 3214, and a central processing unit (CPU) 3210. A bus couples the flash memory 3211, the RAM 3212, the IF 3214, and the CPU 3210 to each other.

The flash memory 3211 holds a program that is executed by the CPU 3210 and various kinds of data that is used for execution of the program by the CPU 3210. The RAM 3212 is a working, storage area for the CPU 3210 to execute the program. The IF 3214 performs bidirectional communication with the printer controller 2090.

The CPU 3210 operates in accordance with the program stored in the flash memory 3211 to control the entire optical scanner 2010.

The interface unit 3022 configured as described above receives the input image data, which is 8-bit RGB data having a resolution N, from the printer controller 2090. Then, the interface unit 3022 transfers the input image data to the image processing unit 3023.

The image processing unit 3023 includes an attribute separator 3215, a color transformer 3216, a black component generator 3217, a gamma (γ) corrector 3218, and a digital halfioning processor 3219.

The attribute separator 3215 receives the input image data (i.e., 8-bit RGB data having the resolution N) from the interface unit 3022. Attribute information (i.e., attribute data) is added to each pixel of the input image data. The attribute information indicates a type of an object as a source of the area (i.e., pixel). For example, if the pixel is a part of a text, the attribute information indicates an attribute of "text". Alternatively, if the pixel is a part of a line, the attribute information indicates an attribute a "line". Alternatively, if the pixel is a part of a graphical shape, the attribute information indicates an attribute of "graphical shape". Alternatively, if the pixel is a part of a photograph, the attribute information indicates an attribute of "photograph".

The attribute separator 3215 separates the attribute information and image data from the input image data. The attribute separator 3215 transmits the image data (i.e., 8-bit RGB data having the resolution N) to the color transformer 3216.

The color transformer 3216 converts the RGB image data thus transmitted from the attribute separator 3215 into image data of cyan, magenta, and yellow (hereinafter referred to as CMY image data). Then, the color transformer 3216 transmits the image data thus converted to the black component generator 3217. The black component generator 3217 generates a black component from the CMY image data thus transmitted from the color transformer 3216, thereby generating the CMYK image data. Then, the black component generator 3217 transmits the CMYK image data to the gamma (γ) corrector 3218.

The gamma (γ) corrector 3218 linearly transforms levels of the respective colors of the CMYK image data thus transmitted from the black component generator 3217 by use of a table or the like. Then, the gamma (γ) corrector 3218 transmits the image data thus transformed to the digital halftoning processor 3219.

The digital halftoning processor 3219 reduces the number of gradation levels of the CMYK image data thus transmitted from the gamma (γ) corrector 3218, thereby outputting 1-bit image data. Specifically, the digital halftoning processor 3219 performs digital halftoning, such as dithering and error diffusion processing, thereby reducing the number of gradation levels of the 8-bit image data to 1 bit. As a consequence, periodic screens (e.g., dot screens and line screens) are formed in the image data. In other words, screens constructing a picture are formed in the image data. Then, the digital halftoning processor 3219 transmits the 1-bit CMYK image data having the resolution N to the driving control unit 3024.

It is to be noted that the image processing unit 3023 is described as is implemented in hardware overall. Alternatively, a part of the image processing unit 3023 may be implemented by execution of a software program by the CPU 3210. In such a case, the image processing unit 3023 includes the interface unit 3022. FIG. 10 illustrates a functional block diagram of a configuration of the image processing unit 3023.

The driving control unit 3024 includes a pixel clock generator 3223, a modulation signal generator 3222, a light source driver 3224, a correction value adjuster 3225, and a random access memory (RAM) 3226.

The pixel clock generator 3223 generates a pixel clock signal indicating when a pixel emits light. The modulation signal generator 3222 modulates the image data transmitted from the image processing unit 3023 into a pixel clock signal, thereby generating an independent modulation signal (i.e., driving signal) for each color.

The light source driver 3224 drives the light source 2200 according to the independent modulation signal transmitted from the modulation signal generator 3222 for each color. Accordingly, the light source driver 3224 drives each of the light source 2200 to perform exposure according to the corresponding modulation signal.

The correction value adjuster 3225 generates exposure correction data (i.e., modulation signal correction data) for each of the light sources 2200 based on output signals from the optical sensors P1 through P5, that is, readings of the density detector 2245. Then, the correction value adjuster 3225 stores the exposure correction data in the RAM 3226. The correction value adjuster 3225 corrects the exposure by the light source 2200 according to the exposure correction data. Although the correction value adjuster 3225 is implemented by a hardware circuit, the correction value adjuster 3225 may partly include software operation. It is to be noted that the correction value adjuster 3225 includes a correction magnification register 3225*a* and a correction magnification parameter 3225*b*. A detailed description of the correction magnification register 3225*a* and the correction magnification parameter 3225*b* is deferred.

The optical scanner 2010 configured as described above forms a latent image on the surface of the photoconductor drum 2030 with the light source 2200 that emits light according to the image data.

Figure 11:
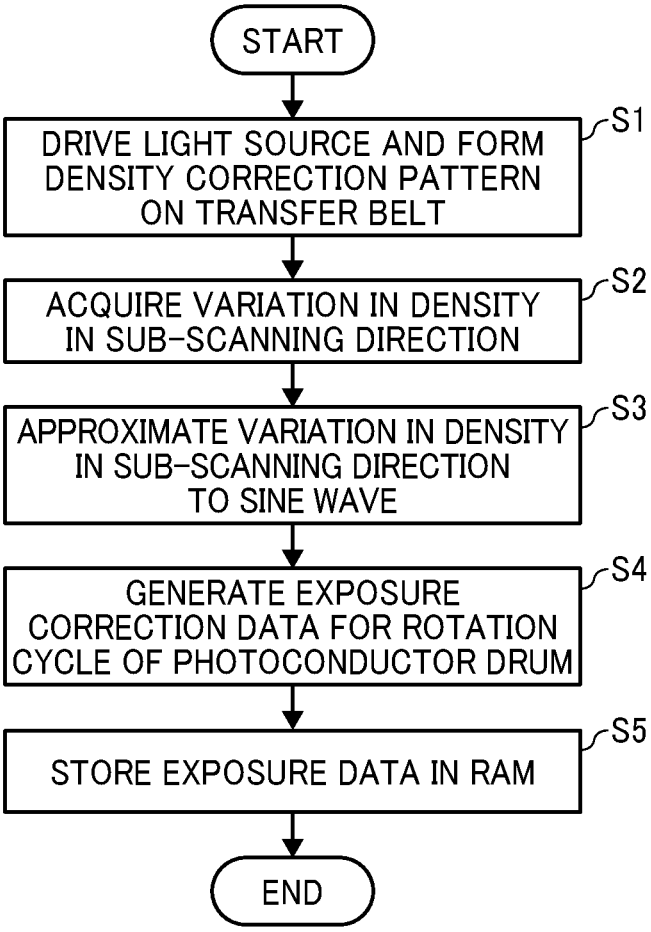
FIG. 11 is a flowchart illustrating a process of acquiring exposure correction data.

Referring now to FIG. 11, a description is given of a procedure to acquire the exposure correction data.

As described above, an eccentric axis of a photoconductor drum and an imperfect round cross-section of the photoconductor drum may vary the size of a gap between the photoconductor drum and a developing roller during an image forming operation. As a consequence, the density of the output image may periodically fluctuate in the sub-scanning direction. To address this circumstance, the correction value adjuster 3225 executes exposure correction data acquisition processing for acquiring exposure correction data to correct a driving signal or exposure by the light source 2200.

FIG. 11 is a flowchart illustrating a process of acquiring the exposure correction data (i.e., exposure correction data acquisition processing) according to the present embodiment.

The process of FIG. 11 is executed by the correction value adjuster 3225. The correction value adjuster 3225 executes the exposure correction data acquisition processing for each of the stations periodically, for example, per 8 hours to 24 hours. The following passage describes the exposure correction data acquisition processing for the station K as a representative of the stations K, C, M, and Y. However, the correction value adjuster 3225 executes the exposure correction data acquisition processing for the other stations (i.e., stations C, M, and Y) similarly.

Initially in step S1, the correction value adjuster 3225 forms a pattern for correction of density (hereinafter referred to as density correction pattern) on the transfer belt 2040. Specifically, the optical scanner 2010 scans the surface of the photoconductor drum 2030 with all the light emitting units of the optical scanner 2010 emitting identical amounts of light. Accordingly, the density correction pattern is formed on the transfer belt 2040. The density correction pattern is a solid pattern for one round of the photoconductor drum 2030 as illustrated in FIG. 4. Then, the LED 11 of each of the optical sensors P1 through P5 is turned on. As the transfer belt 2040 rotates, the detection light from the LED 11 reaches and follows the density correction pattern along the sub-scanning direction.

Subsequently in step S2, the correction value adjuster 3225 acquires variation in density of the density correction pattern in the sub-scanning direction. Specifically, the correction value adjuster 3225 acquires output signals from the specularly reflected light receiving device 12 and the diffusely reflected light receiving device 13 at predetermined time intervals, to calculate toner density for each of the optical sensors P1 through P5 from the output signals, as specifically described below with reference to FIG. 12.

Subsequently in step S3, the correction value adjuster 3225 approximates the variation in density (i.e., variation in density of the density correction pattern) in the sub-scanning direction to a periodic function. Specifically, based on an output signal of the home position sensor 2246*a* (hereinafter referred to as an HP sensor signal), a periodic function (e.g., sine wave) of the same period as a rotation period of the photoconductor drum 2030*a* is extracted as a first periodic pattern from the toner density. The rotation period of the photoconductor drum 2030*a* may be hereinafter referred to as a drum rotation period Td.

Subsequently in step S4, the correction value adjuster 3225 generates exposure correction data for one cycle, that is, for a rotation period of the photoconductor drum 2030*a*. Specifically, the correction value adjuster 3225 converts one cycle of the first periodic pattern acquired in step S3 into the exposure correction data for the rotation period of the photoconductor drum 2030*a*, that is, a second periodic pattern, as specifically described with reference to FIG. 13. Although the first periodic pattern and the second periodic pattern have identical periodic cycles, the second periodic pattern has a phase opposite a phase of the first periodic pattern. That is, the phase of the second periodic pattern is different from a phase of the first periodic pattern by 180°. Thus, the exposure correction data is generated to reduce the variation in density in the sub-scanning direction pertaining to the photoconductor drum 2030*a*. A correction cycle of the exposure correction data thus acquired substantially coincides with the rotation period of the photoconductor drum 2030*a*.

Subsequently in step S5, the correction value adjuster 3225 stores the exposure correction data in the RAM 3226. Specifically, the correction value adjuster 3225 converts an exposure correction value into a difference value quantized, as specifically described below with reference to FIG. 14 that illustrates the number of steps of modulation from a previous scan. Then, the correction value adjuster 3225 stores the difference value in the RAM 3226. Since the difference value is stored instead of an absolute value, a reduced amount of data is stored in the RAM 3226. The number and amount of steps of exposure modulation depend on, e.g., a minimum resolution of the exposure modulation. To address an adverse effect on images, basically, the exposure is modulated for 0, ±1, or ±2 steps of the minimum resolution with respect to one scan.

In addition, to further reduce the amount of data stored in the RAM 3226, the exposure correction data is generated and stored for multiple scans (e.g., four scans), not for each scan. The correction value adjuster 3225 develops and applies the exposure correction value for multiple scans as a correction value for each scan as described later.

When image data is input from the upstream device 100 to the interface unit 3022 via the communication controller 2080 and the printer controller 2090 after the correction value adjuster 3225 executes the exposure correction data acquisition processing described above with reference to in FIG. 11, the image data undergoes predetermined processing in the image processing unit 3023. Then, the image data is transmitted from the image processing unit 3023 to the driving control unit 3024. In the driving control unit 3024, the modulation signal generator 3222 generates a modulation signal (i.e., driving signal) for each color according to the image data, in accordance with a pixel clock generated by and transmitted from the pixel clock generator 3223. Then, the modulation signal generator 3222 transmits the modulation signal to the light source driver 3224. At this time, the correction value adjuster 3225 retrieves the exposure correction data from the RAM 3226 for each of the stations. Then, the correction value adjuster 3225 transmits the exposure correction data to the light source driver 3224.

The light source driver 3224 superimposes the exposure correction data on the modulation signal for each color to correct the modulation signal. Then, the light source driver 3224 outputs the modulation signal thus corrected to each of the light sources 2200. The light source 2200 is driven by the modulation signal corrected to fire, that is, to emit light. With the light from the light source 2200, the surface of the photoconductor drum 2030 is scanned in the main scanning direction as the photoconductor drum 2030 rotates. As a consequence, a toner image is formed on the surface of the photoconductor drum 2030 while variation in density of the toner image is reduced in the sub-scanning direction. That is, a high-quality image is formed on a recording medium.

Figure 12:
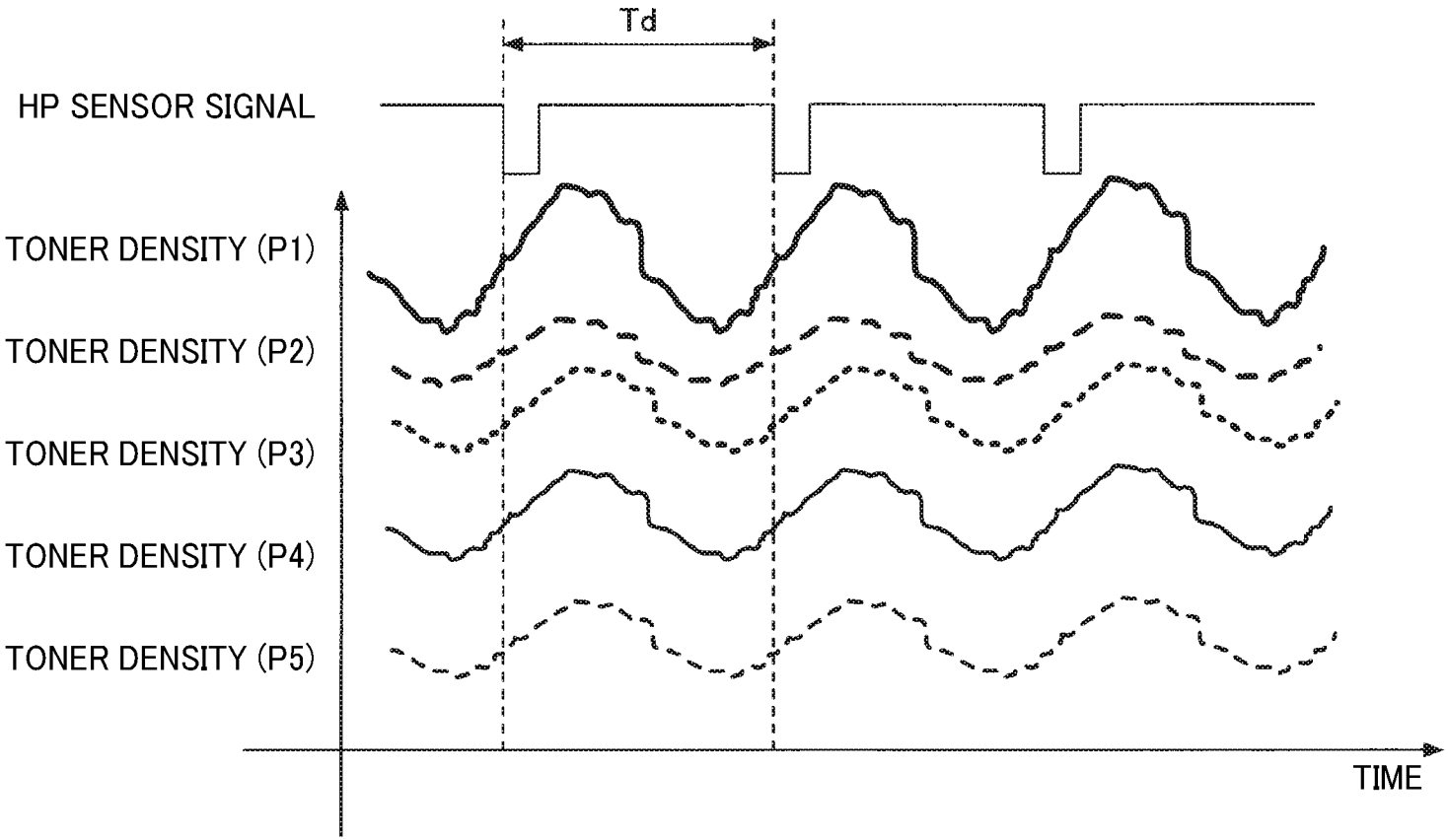
FIG. 12 is a graph illustrating toner density detected by optical sensors incorporated in the density detector.

Referring now to FIG. 12, a description is given of toner density detected.

FIG. 12 is a graph illustrating toner density detected by the optical sensors P1 through P5.

The toner density is measured directly under the optical sensors P1 through P5 aligned in the main scanning direction. As is apparent from the HP sensor signal in FIG. 12, one rotation of the photoconductor drum 2030 coincides with one cycle of the toner density. In addition, the toner density differs in the main scanning direction between the optical sensors P1 through P5. Accordingly, periodic variation in density in the sub-scanning direction and density deviation in the main scanning direction are both obtained.

Figure 13A:
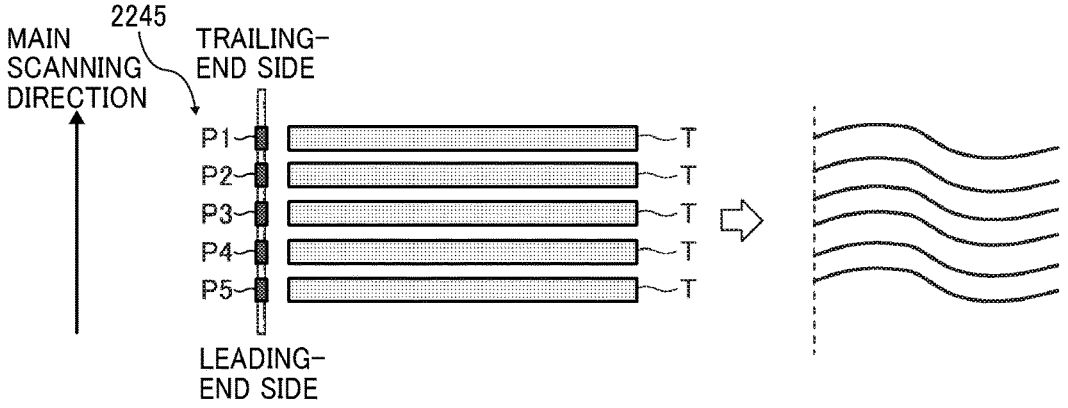
FIG. 13A is a view of the optical sensors and toner images, with a periodic function into which the toner density is converted.

Referring now to FIG. 13A, a description is given of conversion of the toner density into a periodic function.

FIG. 13A is a view of the optical sensors P1 through P5 and toner images, with a periodic function into which the toner density is converted.

FIG. 13A illustrates a sine (SIN) function as the periodic function:

$$An \times \sin(wt+\theta n),$$

where "n" represents an integer of from 1 to 5, "An" represents an amplitude, and "θn" represents a phase.

Alternatively, the periodic function may be a cosine (COS) function. A periodic signal of the toner density is converted into a periodic function by, e.g., quadrature detection or Fourier transform. Although FIG. 13A illustrates only a primary component of the periodic function acquired by the conversion for the sake of simplicity, use of secondary and tertiary components increases approximation accuracy of the toner density.

Figure 13B:
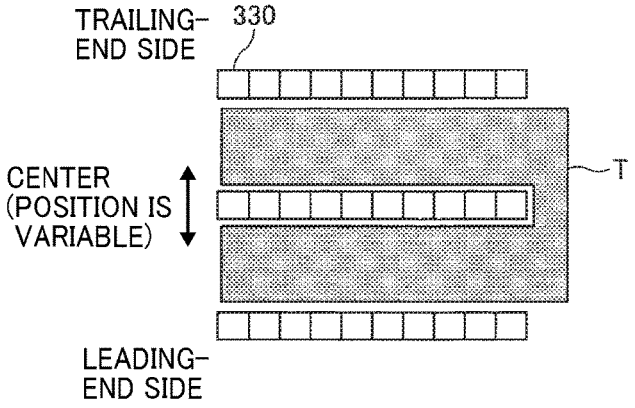
FIG. 13B is a diagram illustrating determination of a position in a main scanning direction to obtain the exposure correction data.
Figure 13C:
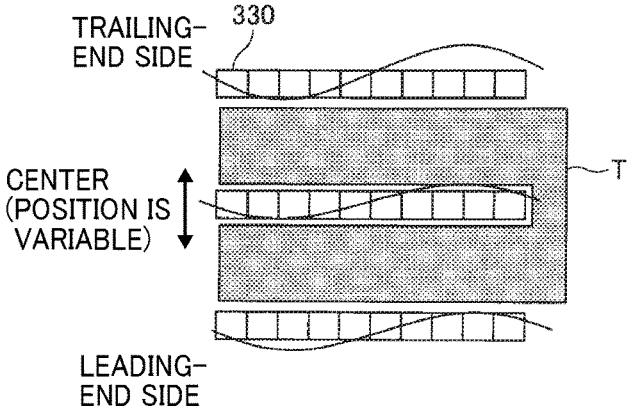
FIG. 13C is a schematic diagram illustrating the exposure correction data.

Referring now to FIGS. 13B and 13C, a description is given of exposure correction.

FIG. 13B is a diagram illustrating determination of a position in the main scanning direction to obtain the exposure correction data.

In the present embodiment, the exposure correction data in the sub-scanning direction is obtained at three positions in the main scanning direction, that is, a leading end position, a center position, and a trailing end position. The leading end position and the trailing end position are outside the effective image area. The center position is not necessarily a physical center of the effective image area, provided that the center position is determined so as to best correct density in a page. Except opposed ends, the amplitude An of the variation in density in the sub-scanning direction is largest at the center position. For example, if an amplitude A2 is the largest, the position of the optical sensor P2 is determined as the center position.

The correction value adjuster 3225 linearly interpolates the exposure correction data between the leading end position and the center position for each predetermined position (i.e., square 330 in FIG. 13B) in the sub-scanning direction. Similarly, the correction value adjuster 3225 linearly interpolates the exposure correction data between the trailing end position and the center position for each predetermined position in the sub-scanning direction. Accordingly, the correction value adjuster 3225 corrects density in the sub-scanning direction in an entire area in the main scanning direction.

It is to be noted that the square 330 in the sub-scanning direction illustrated in FIG. 13B corresponds to one scan, that is, one face of the polygon mirror 2104. FIG. 13B schematically illustrates that the exposure correction value is stored in each of the squares 330. Although the exposure correction data is constructed of exposure correction values, the exposure correction data may not be distinguished from the exposure correction values.

FIG. 13C is a schematic diagram illustrating the exposure correction data.

The exposure correction data is calculated at each of the leading end position, the center position, and the trailing end position. FIG. 13C illustrates the exposure correction data by a periodic curve. The periodic curve of FIG. 13C and the periodic function of FIG. 13A have a phase difference of 180°.

The periodic curve of FIG. 13C is stored in each of the squares 330 as a difference value. That is, in each of the squares 330, a difference from an immediately previous square 330 is stored as an exposure correction value. It is to be noted that an initial value of the exposure correction value (i.e., exposure correction value of the home position) is stored in a register. If the exposure correction value does not become a periodic function with an initial value of zero, a change of the correction magnification involves a change of the above-described initial value. That is, similar to the correction magnification and the cycle, the register storing the initial value is a parameter that changes during an image forming operation. As described above, the exposure correction value is a difference value quantized as in FIG. 14 that illustrates the number of steps of modulation from a previous scan. The number and amount of steps of exposure modulation depend on, e.g., a minimum resolution of the exposure modulation. In other words, for example, the minimum resolution of the exposure modulation determines how much change in the exposure represents an exposure correction value for one unit.

The correction magnification is implemented by changing the number of steps, that is, by increasing or decreasing the number of steps. Alternatively, the correction magnification may be implemented by increasing the resolution of the exposure modulation. For example, by changing a resolution interval of a circuit operation from 0.01% to 0.02%, the exposure that changes by one step is doubled.

Figure 14:
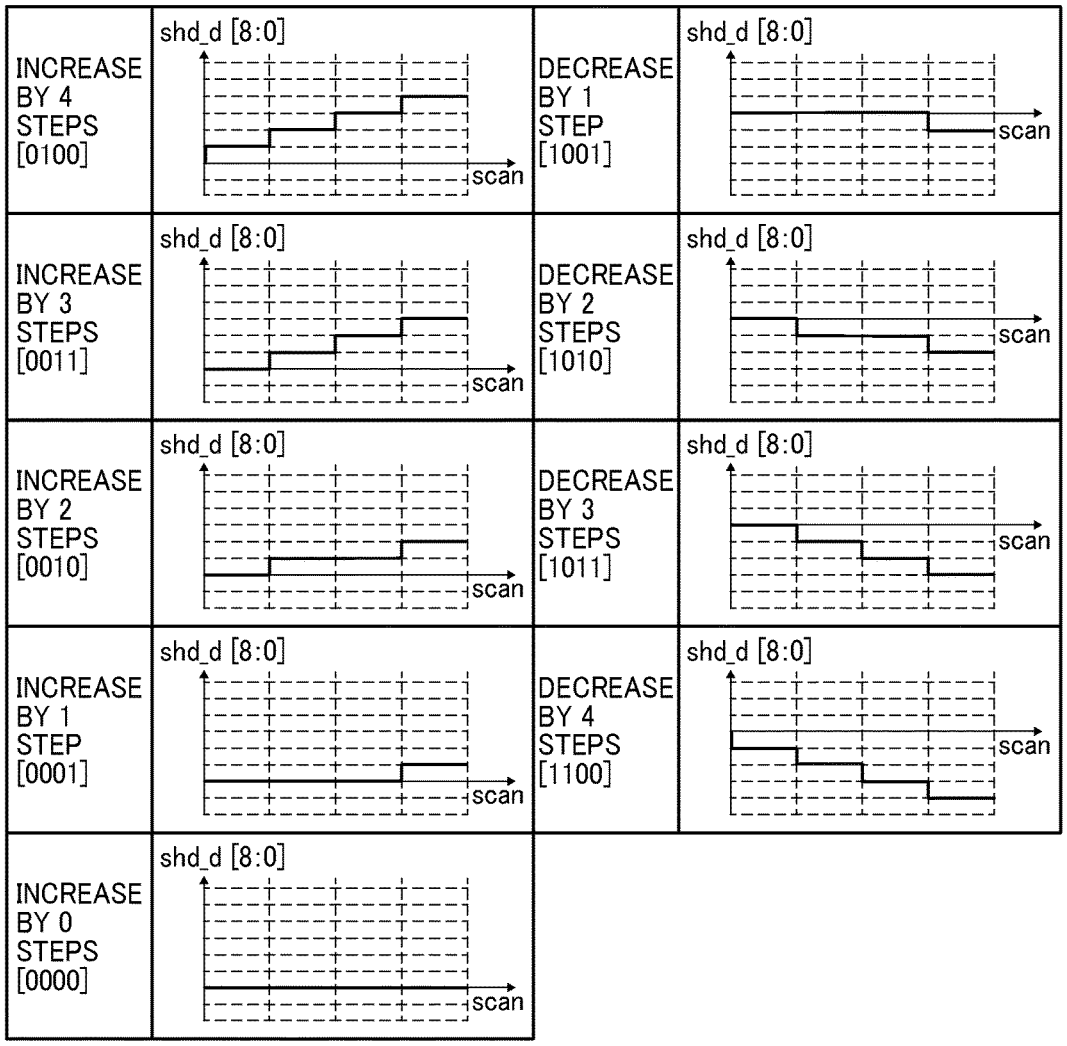
FIG. 14 is a graph of exposure correction values.

Referring now to FIG. 14, a description is given of the exposure correction values.

FIG. 14 is a graph of the exposure correction values.

As described above, the exposure correction value is a difference value quantized as in FIG. 14 that illustrates the number of steps of modulation from a previous scan. The number and amount of steps of exposure modulation depend on, e.g., a minimum resolution of the exposure modulation. In other words, for example, the minimum resolution of the exposure modulation determines how much change in the exposure represents an exposure correction value for one unit.

FIG. 14 illustrates an amount of change (i.e., number of steps) per four scans stored in the RAM 3226. That is, instead of storing the amount of change per scan, the amount of change is stored per four scans in the RAM 3226. Accordingly, the amount of data stored in the RAM 3226 is further reduced. For example, if one byte corresponds to one step, four steps need four bytes. Hence, in the present embodiment, four steps are stored in two bytes (i.e., nine bits [8:0]). In short, the amount of data stored in the RAM 3226 is half.

In addition, a scanning position for one step change is flexible in increase or decrease by one to three steps. For example, as illustrated in graphs of one-step increase and one-step decrease, the data can be changed by one step upon any of first through fourth scans. The correction value adjuster 3225 controls so as not to fix the scanning position for one-step increase or decrease. Accordingly, the exposure is corrected at a periodically determined position to avoid an adverse effect on image quality.

Figure 15:
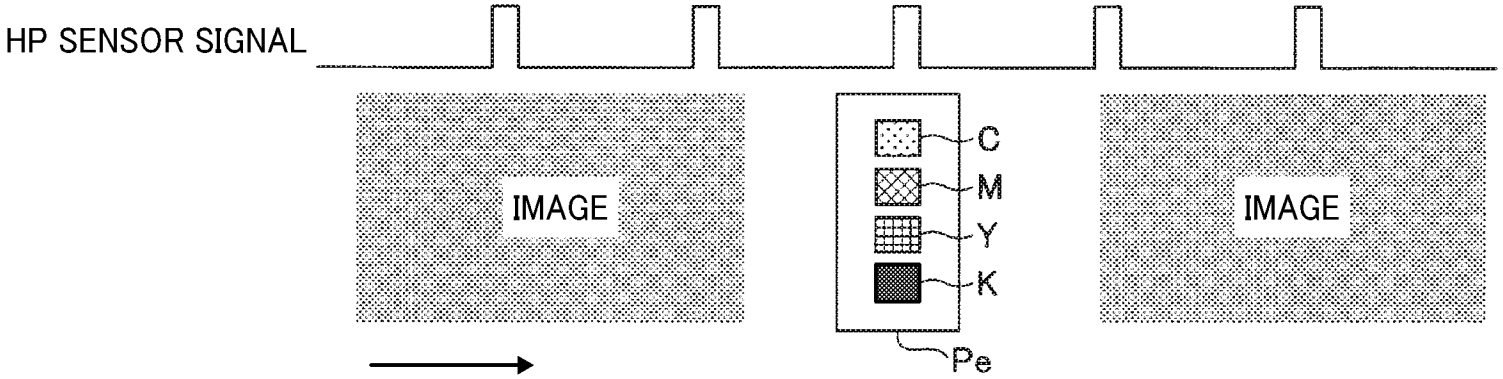
FIG. 15 is a diagram of a pattern for adjustment of image forming conditions formed between images.

Referring now to FIG. 15, a description is given of exposure correction without regeneration of the exposure correction data.

FIG. 15 is a view of the image forming condition adjustment pattern Pe (i.e., pattern for adjustment of image forming conditions) formed between images.

To keep a certain printing quality during execution of a print job, the image forming apparatus 2000 forms the image forming condition adjustment pattern Pe between images, that is, between consecutive recording media, as illustrated in FIG. 15. From density information detected from the image forming condition adjustment pattern Pe, the image forming apparatus 2000 may update and adjust image forming conditions, such as developing bias, charging bias, and exposure energy. Such processing is herein referred to as calibration, adjustment, or feedback of image forming bias.

Such a case may involve the exposure correction data described above. However, if the process illustrated in the flowchart of FIG. 11 is performed, printing productivity may decrease significantly. To address this circumstance, in the present embodiment, the correction value adjuster 3225 adjusts the cycle and amplitude (i.e., correction magnification) of exposure correction, instead of changing the exposure correction data as it is.

Figure 16A:
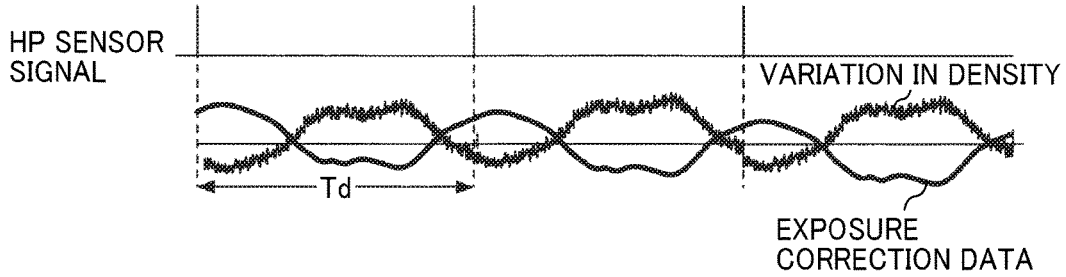
FIG. 16A is a graph of the exposure correction data and variation in density in the sub-scanning direction pertaining to the photoconductor drum when the photoconductor drum rotates at a standard speed.
Figure 16B:
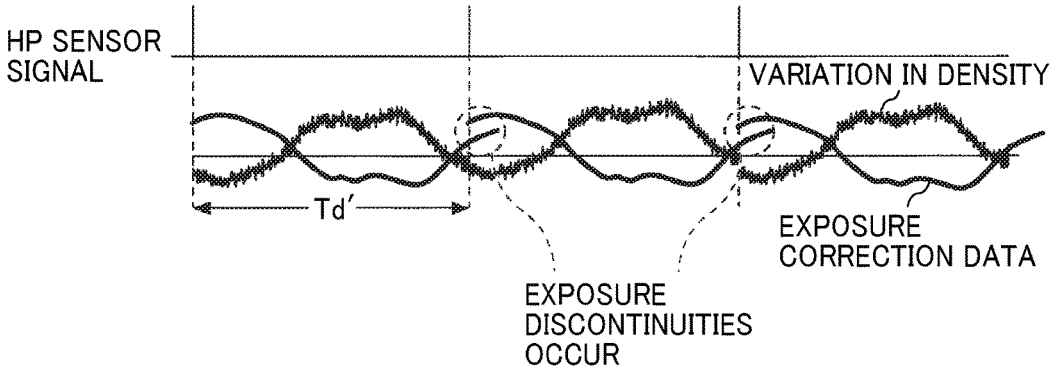
FIG. 16B is a graph of the exposure correction data and the variation in density in the sub-scanning direction pertaining to the photoconductor drum when the photoconductor drum rotates at an increased speed.
Figure 16C:
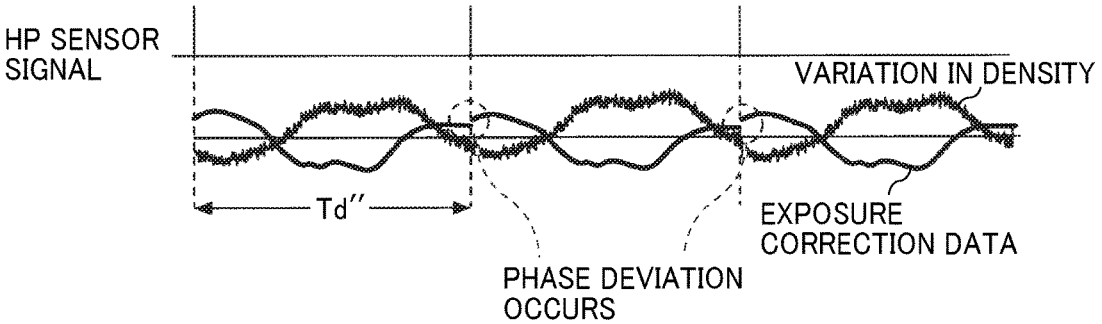
FIG. 16C is a graph of the exposure correction data and the variation in density in the sub-scanning direction pertaining to the photoconductor drum when the photoconductor drum rotates at a decreased speed.

Referring now to FIGS. 16A through 16C, a description is given of changes in rotational speed in association with the image forming conditions.

If the image forming conditions are adjusted or the printing productivity is changed, for example, the rotation period (i.e., linear velocity) of the photoconductor drum 2030 may be changed. Since the exposure correction value is stored in the RAM 3226 for multiple scans as described above, changes in the rotation period of the photoconductor drum 2030 may cause the cycle of the exposure correction data to differ from the cycle of the variation in density rotation period of the photoconductor drum 2030). As a consequence, the variation in density may be inaccurately corrected. Some examples will be described below with reference to FIGS. 16A through 16C.

FIG. 16A is a graph of the exposure correction data and the variation in density in the sub-scanning direction pertaining to the photoconductor drum 2030 when the photoconductor drum 2030 rotates at a standard speed. FIG. 16B is a graph of the exposure correction data and the variation in density in the sub-scanning direction pertaining to the photoconductor drum 2030 when the photoconductor drum 2030 rotates at an increased speed. FIG. 16C is a graph of the exposure correction data and the variation in density in the sub-scanning direction pertaining to the photoconductor drum 2030 when the photoconductor drum 2030 rotates at a decreased speed.

FIG. 16A illustrates a normal or standard state in which the cycle of the exposure correction data substantially coincides with a cycle Td of the variation in density (i.e., drum rotation period Td).

In FIG. 16B, the linear velocity of the photoconductor drum 2030 is changed from the normal state of FIG. 16A such that the photoconductor drum 2030 rotates at an increased speed. In such a case, a cycle Td' of the variation in density (i.e., drum rotation period Td') is shorter than the cycle Td of the variation in density in the normal state of FIG. 16A. Therefore, the cycle of the exposure correction data is longer than the cycle Td' of the variation in density. As a consequence, a step or difference is generated in the exposure correction data upon restart with a next HP sensor signal (i.e., home position sensor output signal). In other words, exposure discontinuities occur.

In FIG. 16C, the linear velocity of the photoconductor drum 2030 is changed from the normal state of FIG. 16A such that the photoconductor drum 2030 rotates at a decreased speed. In such a case, a cycle Td" of the variation in density (i.e., drum rotation period Td") is longer than the cycle Td of the variation in density in the normal state of FIG. 16A. Therefore, the cycle of the exposure correction data is shorter than the cycle Td" of the variation in density. As a consequence, a phase deviation from the variation in density hampers reliable correction.

In the present embodiment, to keep printing productivity unimpaired while reliably reducing the variation in density in images in the sub-scanning direction, the correction value adjuster 3225 executes correction cycle adjustment processing for adjusting the correction cycle of the exposure correction data.

Figure 17:
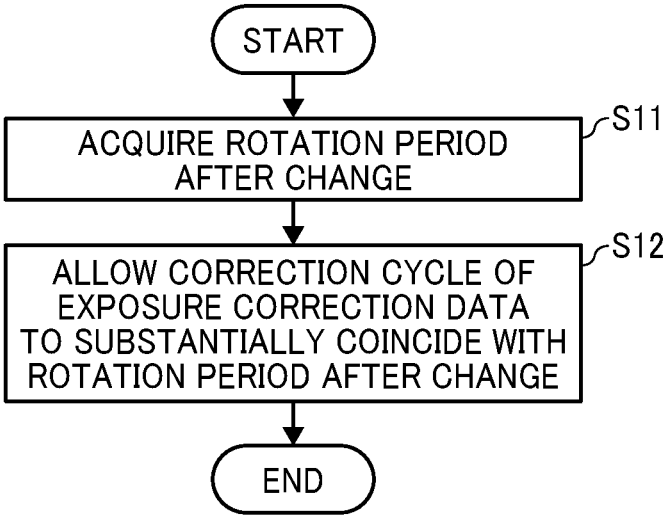
FIG. 17 is a flowchart illustrating a process of adjusting a correction cycle.

Referring now to FIG. 17, a description is given of the correction cycle adjustment processing executed by the correction value adjuster 3225.

FIG. 17 is a flowchart illustrating a process of adjusting the correction cycle (i.e., correction cycle adjustment processing).

The correction value adjuster 3225 executes the process of FIG. 17 in response to a change in the rotation period of the photoconductor drum 2030 for each of the stations after the exposure correction data is obtained. The correction cycle of the exposure correction data substantially coincides with the rotation period of the photoconductor drum 2030 at a time when the exposure correction data is obtained. The correction value adjuster 3225 executes the correction cycle adjustment processing for each of the stations in identical manners. Now, a description is given of the correction cycle adjustment processing for the station K as a representative of the stations K, C, M, and Y.

The correction value adjuster 3225 monitors the rotation period of the photoconductor drum 2030*a* based on an output signal from the corresponding home position sensor 2246*a*. If the correction value adjuster 3225 determines that the rotation period is changed, the correction value adjuster 3225 starts the correction cycle adjustment processing. Specifically, the correction value adjuster 3225 determines that the rotation period is changed if an amount of change in the rotation period is not less than a predetermined value. By contrast, the correction value adjuster 3225 determines that the rotation period is unchanged if the amount of change in the rotation period is less than the predetermined value. Such determination by the correction value adjuster 3225 eliminates erroneous determination due to, e.g., detection error. It is to be noted that the rotation period of the photoconductor drum 2030*a* changes when the linear velocity of the photoconductor drum 2030*a* is changed to adjust the printing productivity, when time degrades a driving system of the photoconductor drum 2030*a* and decreases the linear velocity of the photoconductor drum 2030*a*, when the driving system of the photoconductor drum 2030*a* suffers from minor malfunction, or the like.

Initially in step S11, the correction value adjuster 3225 acquires a rotation period after change. Specifically, the correction value adjuster 3225 acquires the rotation period of the photoconductor drum 2030*a* after change, based on the output signal from the home position sensor 2246*a*.

Subsequently in step S12, the correction value adjuster 3225 allows the correction cycle of the exposure correction data to substantially coincide with the rotation period after change.

Specifically, the correction value adjuster 3225 compares the number of scans or the number of correction value (i.e., exposure correction value) in the exposure correction data for the rotation period of the photoconductor drum 2030*a* stored in the RAM 3226 with the number of scans or the number of correction value required by the change in the rotation period of the photoconductor drum 2030*a*.

If the number of scans required for correction for an actual rotation period of the photoconductor drum 2030*a* is greater than the number of scans or the number of correction value stored in the RAM 3226, the correction value adjuster 3225 changes the number of scans with respect to one exposure correction value, regularly (e.g., periodically, at substantially regular intervals), for the number of scans increased. In other words, if the linear velocity of the photoconductor drum 2030*a* is decreased and the rotation period of the photoconductor drum 2030*a* (i.e., cycle of the variation in density) is longer than the cycle of the exposure correction data, the correction value adjuster 3225 changes the number of scans with respect to one exposure correction value, regularly (e.g., periodically, at substantially regular intervals), for the number of scans increased.

Figure 18:
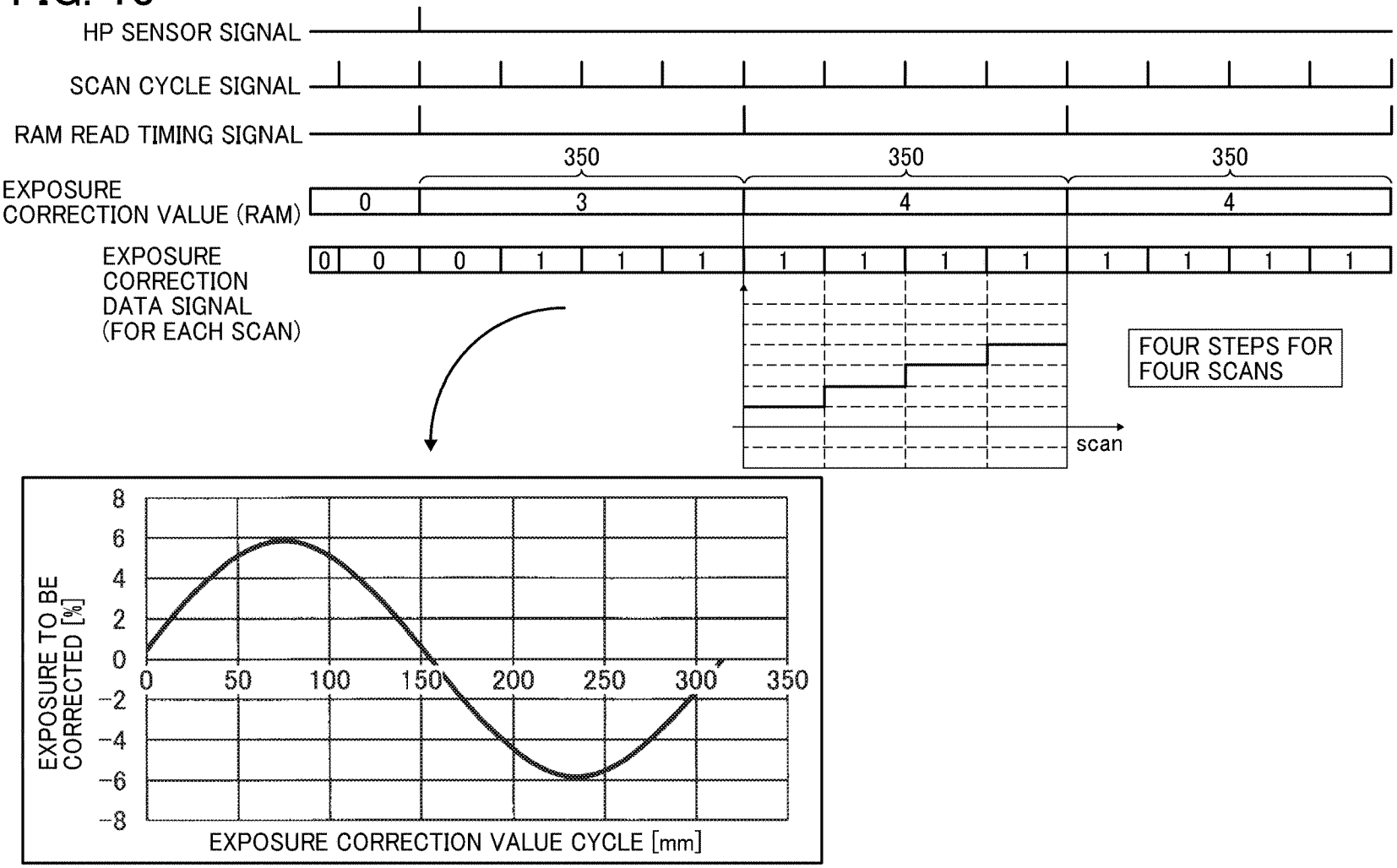
FIG. 18 is a diagram illustrating a relation between an exposure correction value and the number of scans when a rotational speed is unchanged.

FIG. 18 is a diagram illustrating a relation between an exposure correction value and the number of scans when the rotational speed is unchanged, that is, in the normal or standard state.

It is to be noted that a sine curve illustrated in FIG. 18 indicates exposure corrected by the exposure correction data. As described above, normally, four scans are performed for one exposure correction value. For example, if the exposure correction value is 4, one step is assigned to one scan. That is, the exposure correction value is stored in the RAM 3226 in units of four scans. The exposure correction value is applied in the entire area in the sub-scanning direction per four scans.

Figure 19:
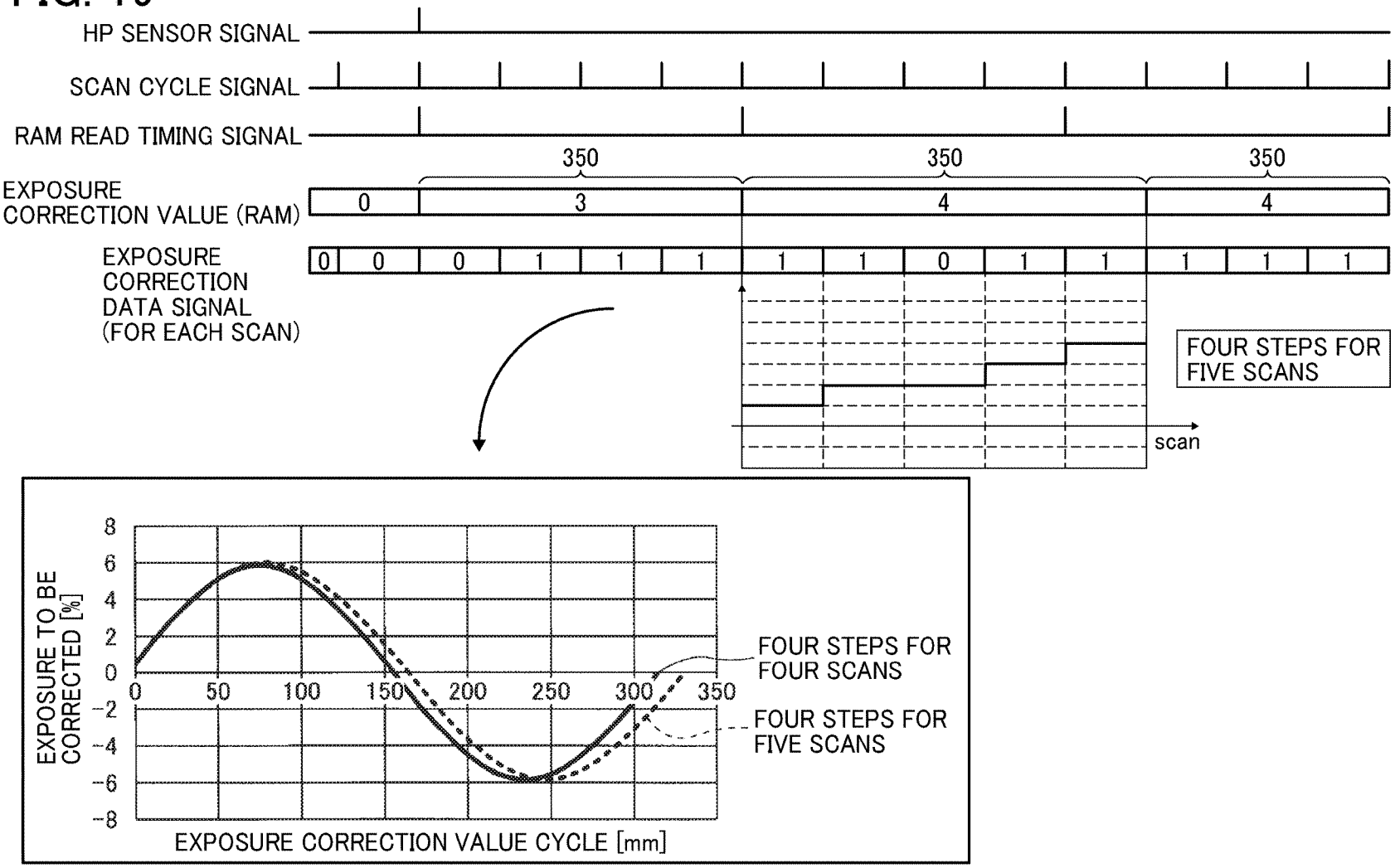
FIG. 19 is a diagram illustrating a relation between an exposure correction value and the number of scans when a rotation period is lengthened.

FIG. 19 is a diagram illustrating a relation between an exposure correction value and the number of scans when the rotational period is lengthened.

When the rotational period is lengthened, a section 350 is generated in which five scans are performed for one exposure correction value. For example, if the exposure correction value is 4, one or zero steps are assigned to one scan. That is, since the exposure correction value is 4 at maximum, zero steps are assigned to an additional one scan in the section 350 in which five scans are performed. Accordingly, even if five scans are performed, the total number of steps is identical to the exposure correction value (e.g., 4).

It is to be noted that the exposure correction value does not necessarily correspond to four scans, provided that the exposure correction value corresponds to a plurality of scans. In addition, the number of scans for which zero steps are assigned is not limited to one scan. Alternatively, zero steps may be assigned to a plurality of scans. As described above, in the present embodiment, scans to which zero steps are assigned are added regularly (e.g., periodically, at substantially regular intervals). Alternatively, the scans to which zero steps are assigned may be added at random, that is, irregularly. The number of scans to which zero steps are assigned depends on the increase in the rotational speed.

Thus, execution of the processing equivalent to regularly inserting a scan to which zero steps are assigned lengthens or modulates the correction cycle for the rotation period of the exposure correction data, thereby allowing the correction cycle to substantially coincide with the rotation period after change. As illustrated in FIG. 19, a sine curve of four steps for five scans is longer than a sine curve of four steps for four scans.

Figure 20:
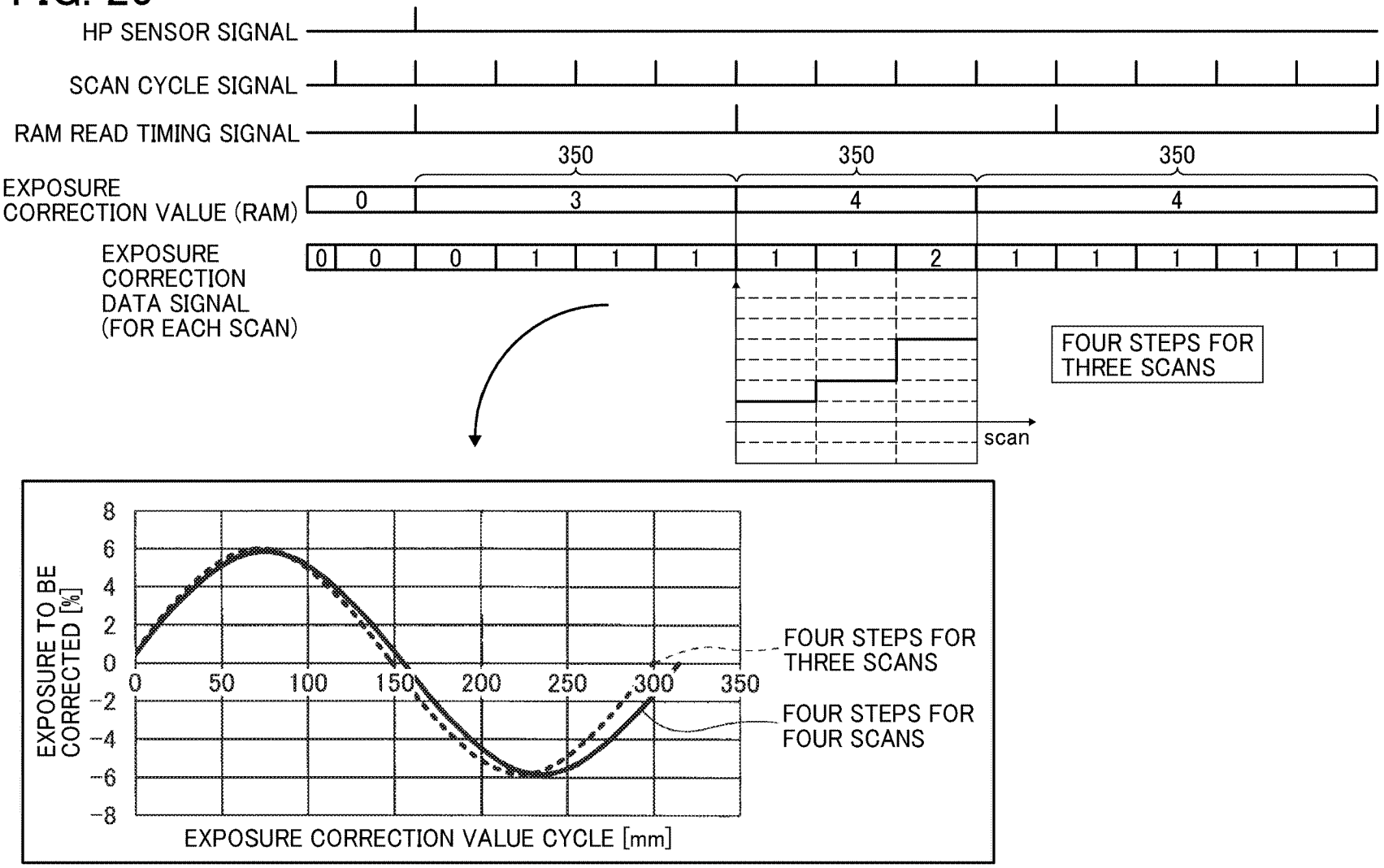
FIG. 20 is a diagram illustrating a relation between an exposure correction value and the number of scans when the rotation period is shortened.

FIG. 20 is a diagram illustrating a relation between an exposure correction value and the number of scans when the rotation period is shortened.

In such a case, two steps are assigned to one scan in the section 350 in which the number of scans are decreased. For example, if the exposure correction value is 4, the data is changed by four steps for three scans. That is, the exposure is changed by 2 steps in any one of first through third scans. FIG. 20 illustrates two-step change in the third scan. Accordingly, even if three scans are performed in a single section 350, the number of steps can be identical to an exposure correction value of 4.

As described above, in the present embodiment, the exposure correction value is stored per four scans. The number of scans for which the exposure correction value is stored is not limited to four, provided that the exposure correction value is stored for multiple scans. In addition, the number of scans decreased in a single section 350 is not limited to one scan, but may be a plurality of scans, provided that a total number of the correction values is unchanged. The number of scans may be decreased regularly (e.g., periodically, at substantially regular intervals), or at random, that is, irregularly. As illustrated in FIG. 20, a sine curve of four steps for three scans is shorter than a sine curve of four steps for four scans.

Thus, when the rotational speed is changed and the cycle of the exposure correction data does not coincide with the cycle of the variation in density, the correction cycle of the exposure correction data is adjusted to correct for the disagreement. That is, the cycle of the exposure correction data approaches the cycle of the variation in density without re-calculation of the exposure correction data. In other words, an increase in time for calculation and transfer is suppressed. As a consequence, printing productivity is unimpaired while unevenness in density of images in the direction of rotation R1 of the photoconductor drum 2030 is reliably suppressed.

Now, a detailed description is given of correction of the amplitude in association with variation in density over time. For example, time changes characteristics (e.g., surface conditions) of photoconductor drums and characteristics of light sources. Such a change may hamper sufficient suppression of variation in density depending on the exposure correction data stored in the RAM 3226. To address this circumstance, fine adjustment of the exposure correction data is preferable in response to changes in efficacious correction of the exposure by the light sources on the image density, for example. However, such fine adjustment may lengthen the time for re-calculation and transfer of the exposure correction data as described above, resulting in impaired printing productivity.

Figure 21:
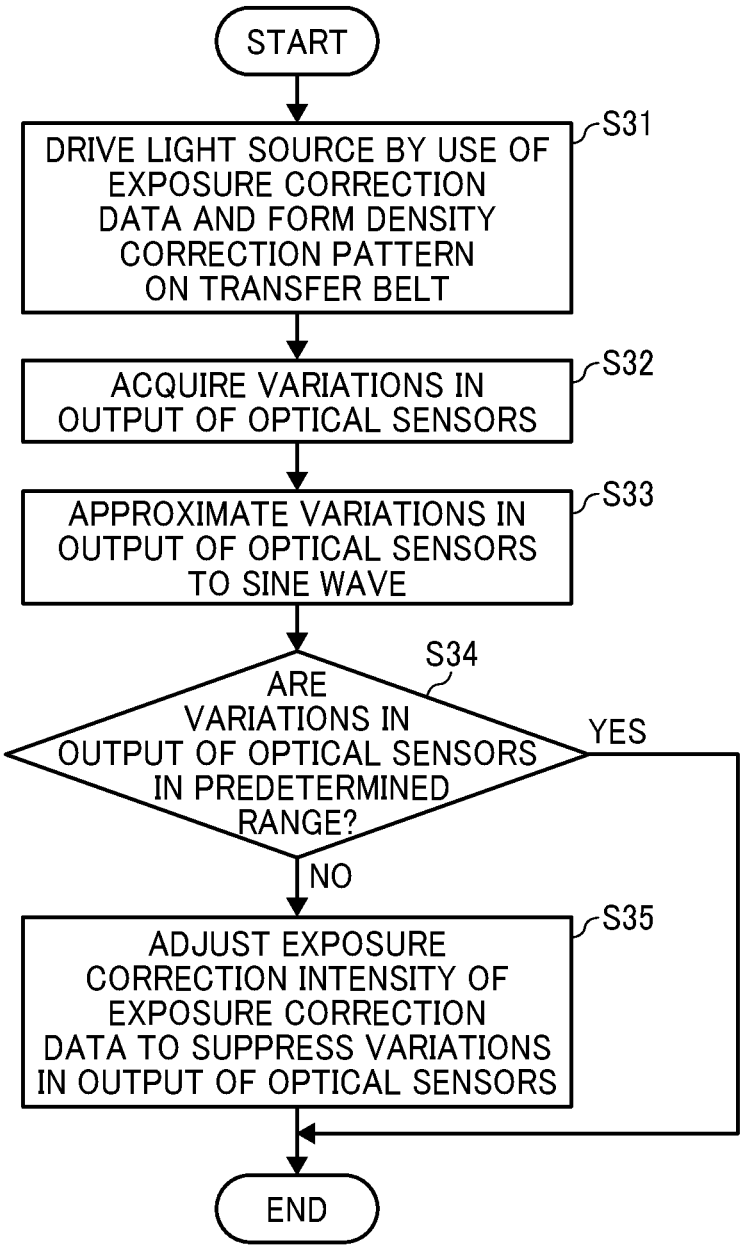
FIG. 21 is a flowchart illustrating a process of adjusting exposure correction intensity executed by a correction value adjuster.

To address this circumstance, that is, to keep printing productivity unimpaired and reduce variation in density in images in the sub-scanning direction, the correction value adjuster 3225 executes exposure correction intensity adjustment processing. Referring now to FIG. 21, a description is given of the exposure correction intensity adjustment processing executed by the correction value adjuster 3225.

FIG. 21 is a flowchart illustrating a process of adjusting the exposure correction intensity (i.e., exposure correction intensity adjustment processing) executed by the correction value adjuster 3225.

The correction value adjuster 3225 executes the exposure correction intensity adjustment processing for each of the stations after a predetermined period of time elapses from execution of the exposure correction data acquisition processing.

Initially in step S31, the correction value adjuster 3225 drives the light source 2200 by use of the exposure correction data and forms a density correction pattern on the transfer belt 2040. Specifically, the correction value adjuster 3225 superimposes the exposure correction data on the modulation signal (i.e., driving signal) to drive the light source 2200. That is, the correction value adjuster 3225 forms the density correction pattern similarly to the step S1 of FIG. 11 described above.

Subsequently in step S32, the correction value adjuster 3225 acquires variations in output of the optical sensors P1 through P5, similarly to the step S2 of FIG. 11 described above.

Subsequently in step S33, the correction value adjuster 3225 approximates the variations in output of the optical sensors P1 through P5 to a sine wave, similarly to the step S3 of FIG. 11 described above.

Subsequently in step S34, the correction value adjuster 3225 determines whether the variations in output of the optical sensors through P5 are in a predetermined range. Specifically, the correction value adjuster 3225 determines whether a peak value of the variations in output of the optical sensors P1 through P5 is equal to or less than a predetermined value. If the correction value adjuster 3225 determines that the peak value is equal to or less than the predetermined value (Yes in S34), then, the flow or process ends. By contrast, if the correction value adjuster 3225 determines that the peak value is not equal to or less than the predetermined value (No in S34), then, the flow or process goes to step S35.

In step S35, the correction value adjuster 3225 adjusts an exposure correction intensity of the exposure correction data to suppress the variations in output of the optical sensors P1 through P5. In short, the correction value adjuster 3225 adjusts magnification (i.e., amplitude) with respect to the exposure correction data.

Specifically, based on the exposure correction data (a difference value from a previous scan) stored in the RAM 3226, without rewriting the value stored in the RAM 3226, the correction value adjuster 3225 increases or decreases a correction value (i.e., exposure correction intensity) of the exposure correction data from the previous scan by a magnification ratio required for correction, depending on the variations in output of the optical sensors P1 through P5.

Figure 22:
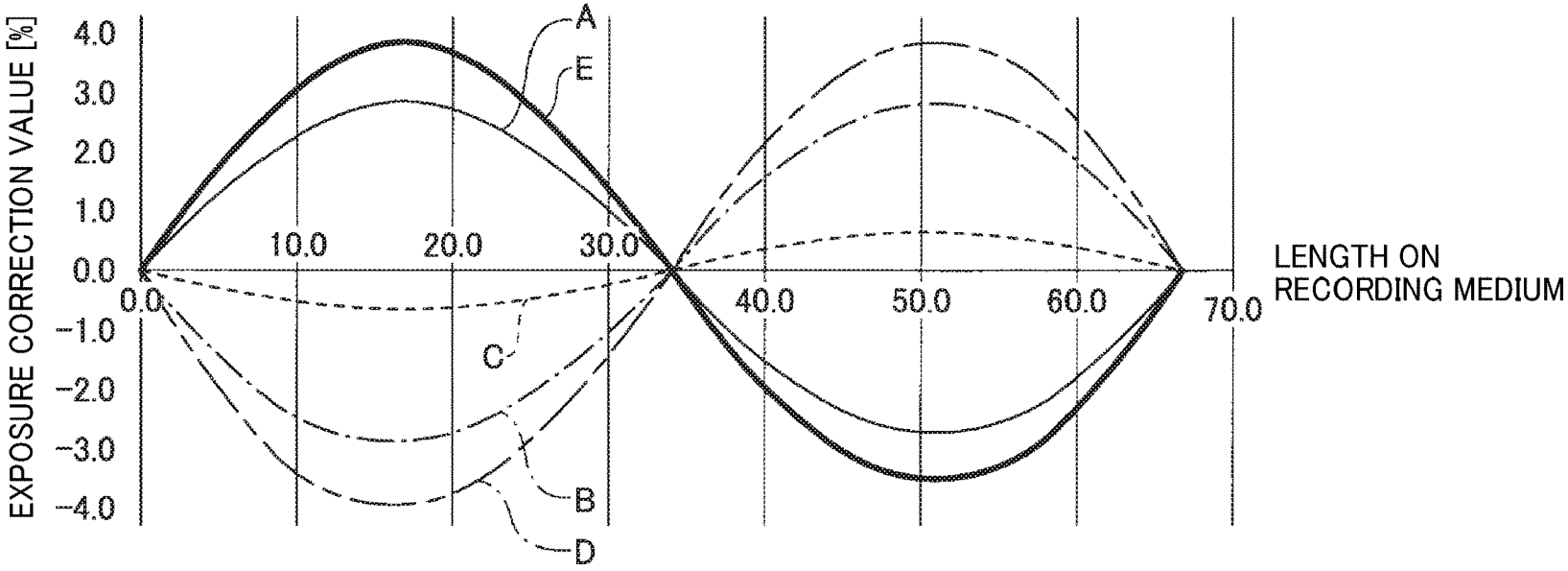
FIG. 22 is a graph of variation in density.

For example, FIG. 22 is a graph of variation in density.

In FIG. 22, a signal A represents exposure correction data. A signal B represents variation in density when the exposure correction data is acquired. A signal C represents output variation (when the exposure correction data is used after a predetermined period of time elapses). A signal D represents variation in density (after the predetermined period of time elapses.) A signal E represents exposure correction data after signal intensity is adjusted. Since the signal B is smaller than the signal D (i.e., B<D), the variation in density remains, though the exposure correction data is used. That is, the variation in density increases after the predetermined period of time elapses from acquisition of the exposure correction data, resulting in insufficient correction of the variation in density with the exposure correction data. In such a case, the correction value adjuster 3225 increases the exposure correction intensity.

Figure 23:
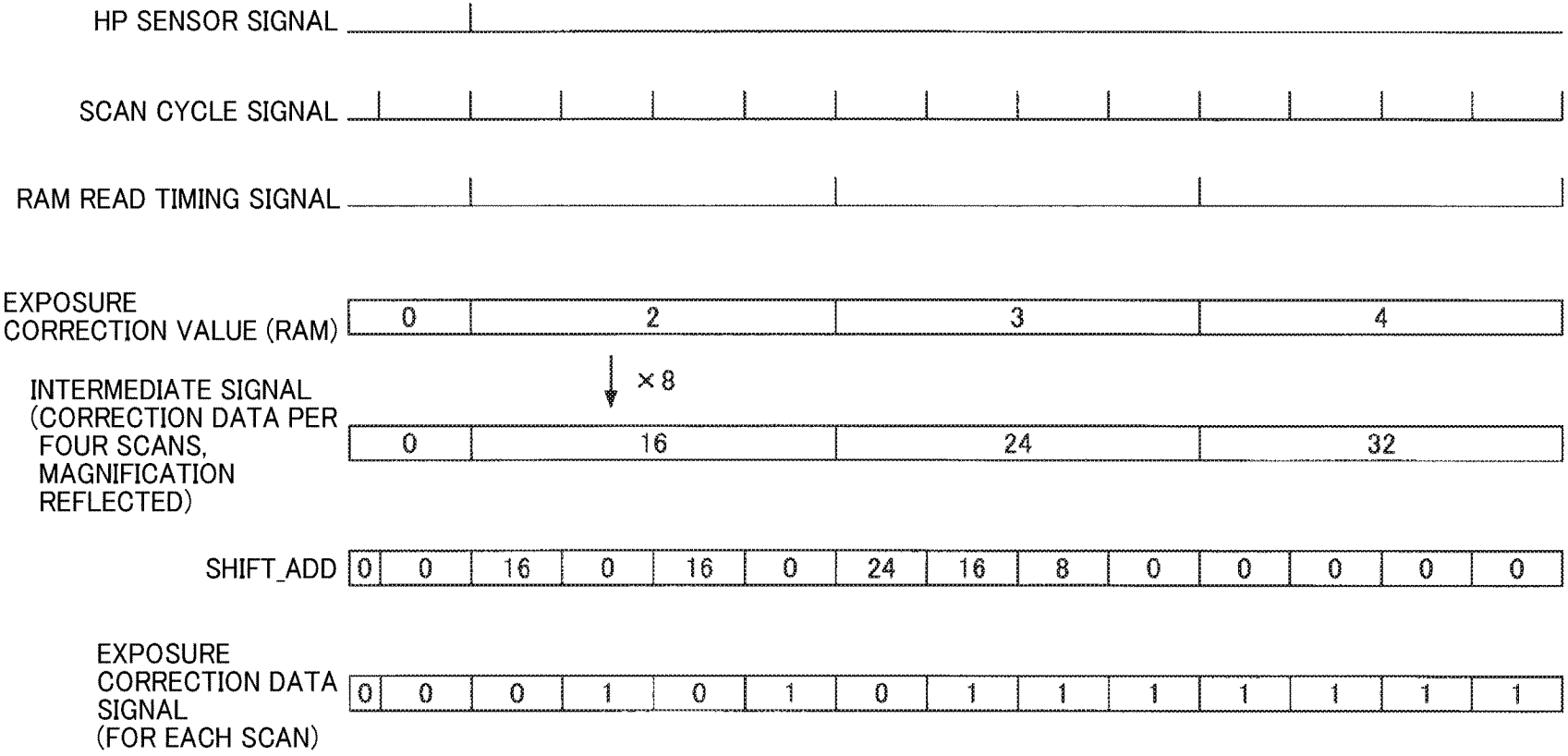
FIG. 23 is a diagram illustrating generation of an intermediate signal when adjustment of correction magnification is unnecessary.

For comparison, a description is given of how the correction magnification is adjusted when the signal B equals to the signal D (i.e., B=D) with reference to FIG. 23.

FIG. 23 is a diagram illustrating generation of an intermediate signal when adjustment of the correction magnification is unnecessary, that is, with a standard correction magnification of eight times.

In FIG. 23, an HP sensor signal is a signal that indicates a home position of the photoconductor drum 2030. A scanning cycle signal is a signal that indicates a cycle of one scan with the polygon mirror 2104. A RAM read timing signal indicates when the correction value adjuster 3225 reads out or retrieves an exposure correction value from the RAM 3226. The exposure correction value indicates a value stored in the RAM 3226. The intermediate signal indicates an exposure correction value generated by a correction magnification of eight times in FIG. 23. A shift_add indicates a value exceeding 32 of a value of the intermediate signal added to an immediately previous shift_add for each scan. An exposure correction data signal indicates the number of steps to change exposure by a shift_add of 1, which is produced by shifting the shift_add when the shift_add exceeds 32. It is to be noted that "32" indicates eight times of 4, which is a number of scans in a single section 350. Accordingly, in FIG. 23, the number of steps increased in the single section 350 is 4 at maximum, remaining in a standard state.

It is to be noted that the intermediate signal, the shift_add, and the exposure correction data signal are included in a register of the correction value adjuster 3225 or the light source driver 3224, and calculated in synchronization with the clock signal.

For example, if the exposure correction value is 2, the exposure correction data signal is also 2. If the exposure correction value is 3, the exposure correction data signal is also 3. If the exposure correction value is 4, the exposure correction data signal is also 4. That is, FIGS. 18 and 23 illustrate identical exposure correction, because the correction magnification is eight. The exposure correction intensity is increased if the correction magnification is greater than eight. By contrast, the exposure correction intensity is decreased if the correction magnification is less than eight.

Figure 24:
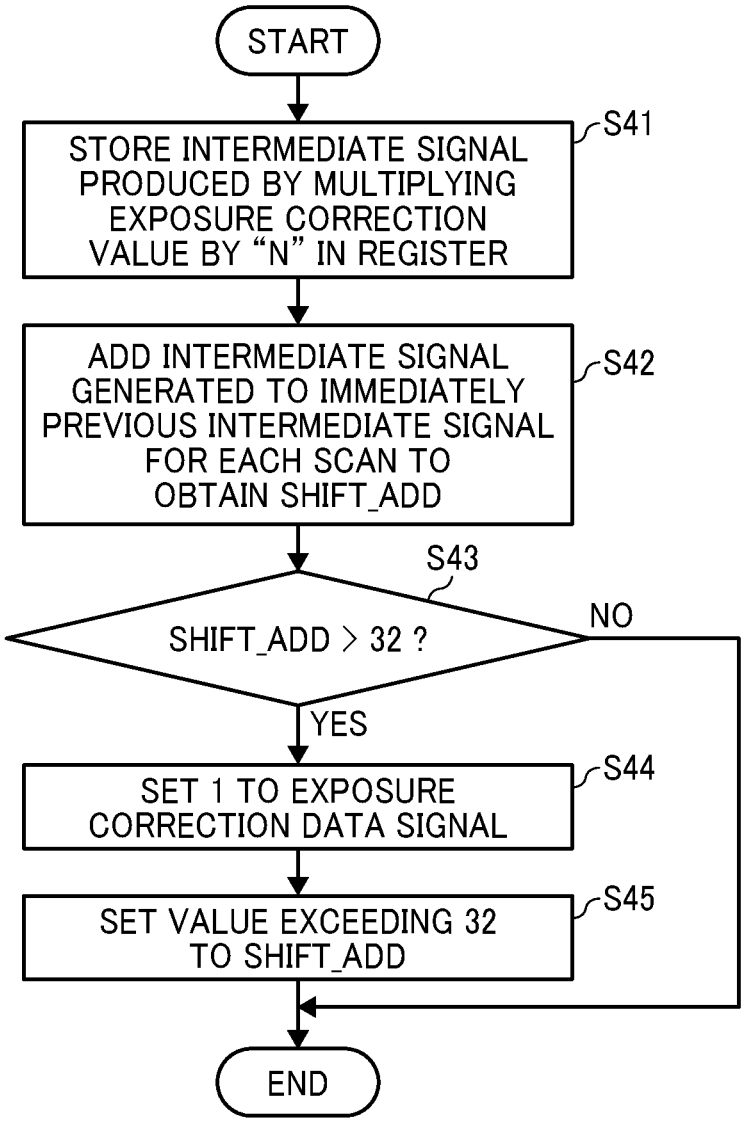
FIG. 24 is a flowchart illustrating a process of generating an exposure correction data signal.

FIG. 24 is a flowchart illustrating a process of generating the exposure correction data signal.

The process of FIG. 24 is executed in synchronization with the clock signal during repeated scans after the exposure correction data is generated.

In step S41, the correction value adjuster 3225 stores an intermediate signal, which is produced by multiplying the exposure correction value by "N", in the register of the correction value adjuster 3225 or the light source driver 3224. An "N" of eight is a standard number by which the exposure correction value is multiplied. An "N" larger than eight means an increase in the exposure correction intensity. By contrast, an "N" smaller than eight means a decrease in the exposure correction intensity.

Subsequently in step S42, the correction value adjuster 3225 adds an intermediate signal generated to a shift_add prior to one scan (i.e., immediately previous intermediate signal) for each scan to obtain a shift_add.

Subsequently in step S43, the correction value adjuster 3225 determines whether the shift_add is greater than 32 (i.e., shift_add>32). If the correction value adjuster 3225 determines that the shift is not greater than 32 (No in S43), then, the process of FIG. 24 ends.

By contrast, if the correction value adjuster 3225 determines that the shift is greater than 32 (Yes in S43), then, the correction value adjuster 3225 sets 1 to the exposure correction data signal in step S44. Accordingly, the exposure is changed by one step.

In step S45, the correction value adjuster 3225 sets a value exceeding 32 to the shift_add. The light source driver 3224 corrects the exposure by use of the exposure correction data signal. The process described above is repeated for each scan.

Figure 25:
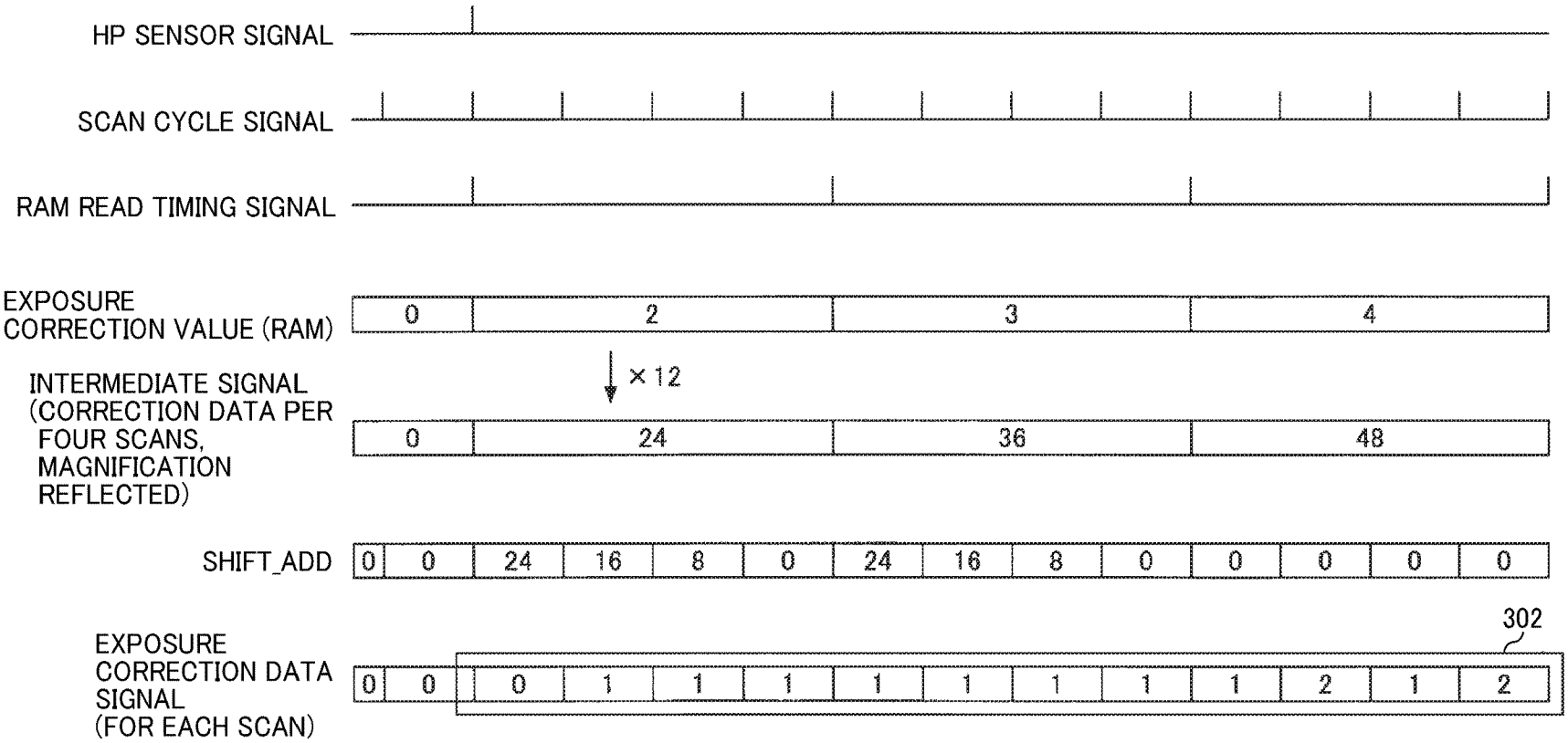
FIG. 25 is a diagram illustrating generation of the intermediate signal with a correction magnification of twelve times.

FIG. 25 is a diagram illustrating generation of the intermediate signal with a correction magnification of twelve times, that is, with an increased correction magnification.

Since the exposure correction value is multiplied by twelve, a correction signal is greater than the correction signal illustrated in FIG. 23. As a consequence, the shift exceeds 32 at an increased frequency. That is, the exposure correction data signal becomes 1 at an increased frequency. For example, in the section 350 in which the exposure correction value is 2, a total number of the exposure correction data signals is 3. In a frame 302 in FIG. 25, the exposure correction data signal includes 13 steps. On the other hand, the exposure correction data signal includes 9 steps in FIG. 23 that illustrates a case with a correction magnification of eight times. In short, as the correction magnification increases, the number of steps of the exposure correction data signal increases. Accordingly, in FIG. 25, an increased exposure is corrected compared to the exposure corrected in FIG. 23. That is, when the variation in density increases after the predetermined period of time elapses from acquisition of the exposure correction data, the exposure correction intensity is increased to sufficiently correct for the variation in density with the exposure correction data.

Figure 26:
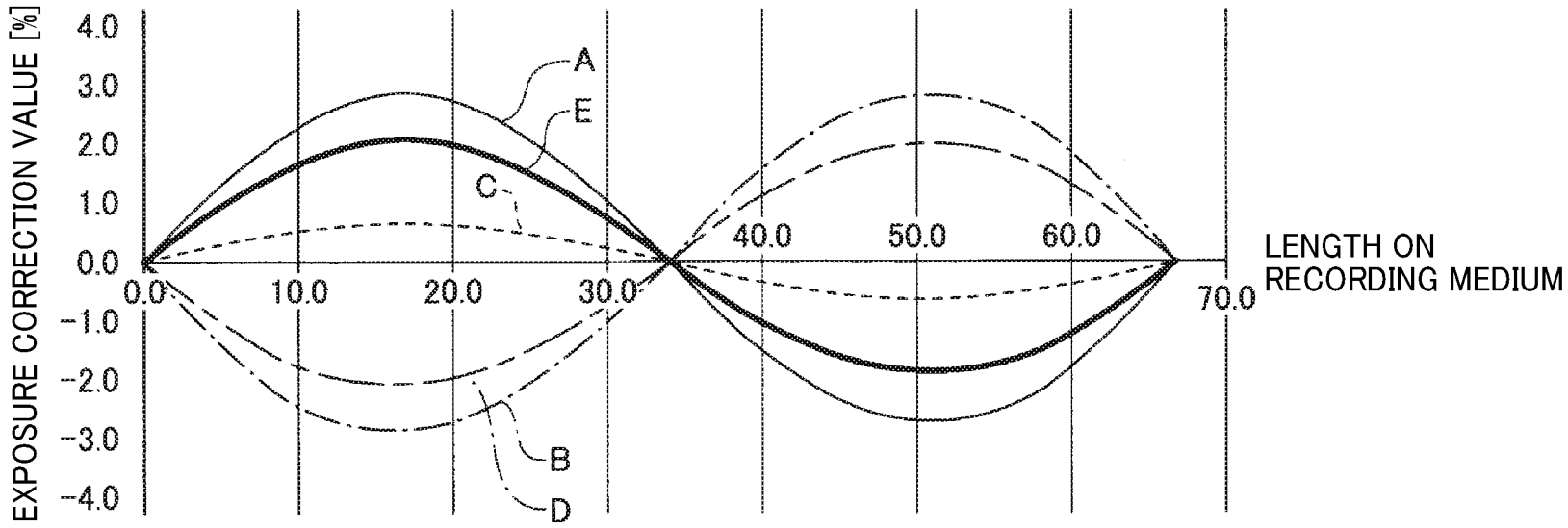
FIG. 26 is a graph of variation in density when an exposure is excessively corrected.

FIG. 26 is a graph of variation in density when the exposure is excessively corrected.

Since the signal B is greater than the signal D (i.e., B>D), use of the exposure correction data results in excessive correction of the density. That is, the variation in density decreases after the predetermined period of time elapses from acquisition of the exposure correction data, resulting in excessive correction of the variation in density with the exposure correction data. In such a case, the correction value adjuster 3225 decreases the exposure correction intensity.

Figure 27:
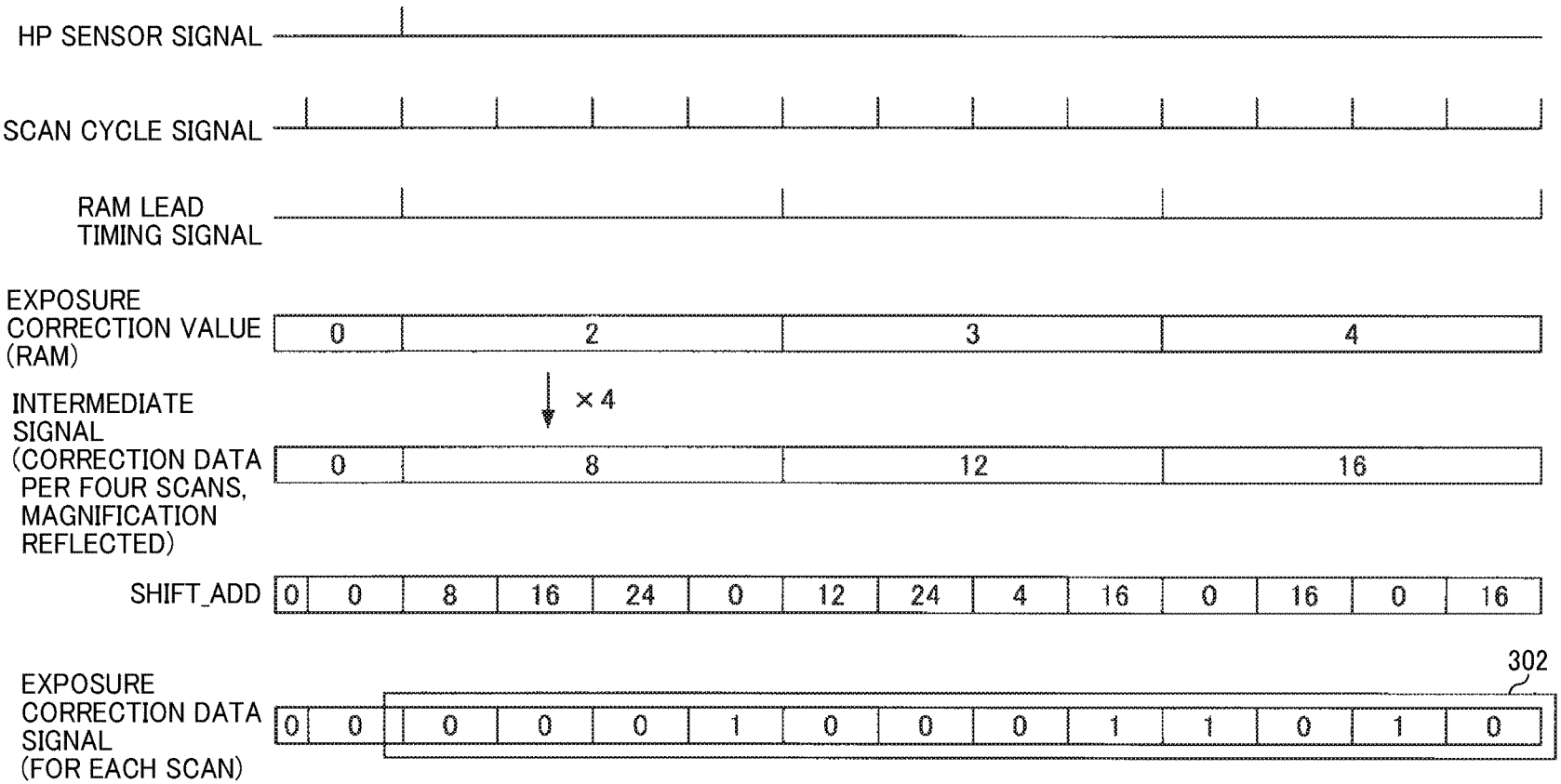
FIG. 27 is a diagram illustrating generation of the intermediate signal with a correction magnification of four times.

FIG. 27 is a diagram illustrating generation of the intermediate signal with a correction magnification of four times, that is, with a decreased correction magnification. Since the exposure correction value is multiplied by four, the correction signal is greater than the correction signal illustrated in FIG. 23. As a consequence, the shift_add exceeds 32 at a decreased frequency. That is, the exposure correction data signal becomes 1 at a decreased frequency. For example, in the section 350 in which the exposure correction value is 2, a sum of the exposure correction data signals is 1. In the frame 302 in FIG. 27, the exposure correction data signal includes 4 steps. On the other hand, the exposure correction data signal includes 9 steps in FIG. 23 that illustrates a case with a correction magnification of eight times. In short, as the correction magnification decreases, the number of steps of the exposure correction data signal decreases. Accordingly, in FIG. 27, a decreased exposure is corrected compared to the exposure corrected in FIG. 23. That is, when the variation in density decreases after the predetermined period of time elapses from acquisition of the exposure correction data, the exposure correction intensity is decreased to prevent excessive correction of the variation in density with the exposure correction data.

As described above, the correction value adjuster 3225 generates the intermediate signal that reflects a magnification setting, from the exposure correction value stored in the RAM 3226. Then, the correction value adjuster 3225 generates the exposure correction data signal from the intermediate signal. Accordingly, the density is corrected without reduction of the printing productivity such as re-generation of the exposure correction data itself.

Now, a description is given of a first embodiment of the present disclosure.

When the image forming conditions are changed based on the image forming condition adjustment pattern Pe during a print job, the cycle and magnification of the exposure correction are adjusted as described above. Since the exposure is corrected based on the HP sensor signal, adjustment of the cycle and magnification of the exposure correction are preferably timed with the HP sensor signal. However, since writing of image data and the rotation period of the photoconductor drum 2030 are not synchronized basically, changes in the correction cycle or magnification during a scanning operation of the optical scanner 2010 may rapidly change the exposure, producing faulty images.

Figure 28:
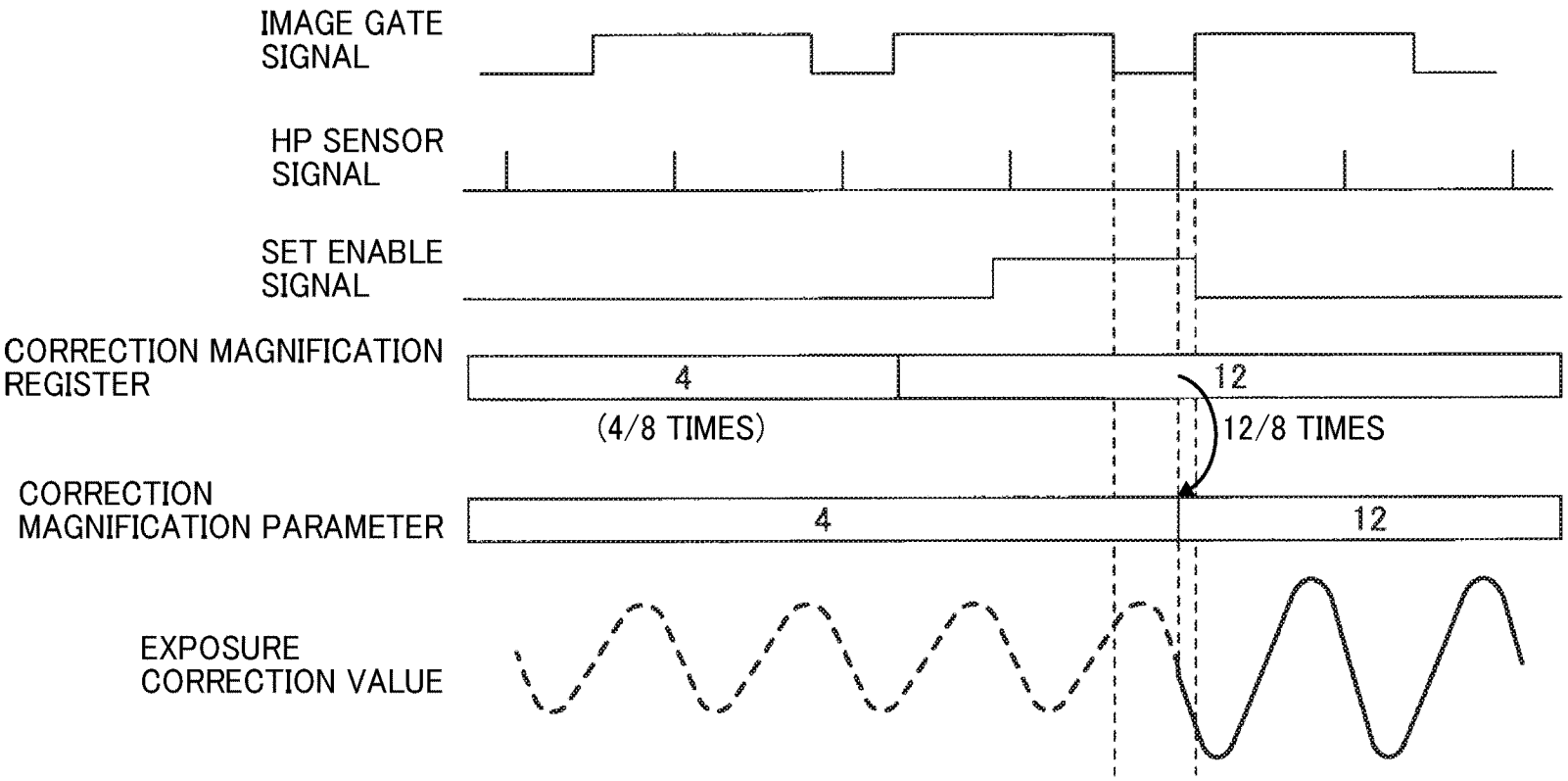
FIG. 28 is a timing chart of exposure correction according to a first embodiment.

Hence, in the present embodiment, at least one of the correction magnification and the cycle of the exposure correction value is adjusted in a process as illustrated in FIG. 28.

FIG. 28 is a timing chart of exposure correction according to the first embodiment.

The following passage describes adjustment of the correction magnification with reference to FIG. 28. However, the correction cycle is adjusted in a similar manner. It is to be noted that an image gate signal asserted indicates that the optical scanner 2010 is activated to form a latent image with light. By contrast, the image gate signal negated indicates that the optical scanner 2010 is deactivated. A set enable signal enabled indicates that setting of the register of the correction value adjuster 3225 or the light source driver 3224 is completed. Such a register includes, e.g., the correction magnification register 3225*a* in which the correction magnification is set. The correction magnification parameter 3225*b* is a value that is a copy of a value of the correction magnification register 3225*a*. Similarly, the correction magnification parameter 3225*b* is implemented as a register. The light source driver 3224 refers to the correction magnification parameter 3225*b*. That is, the light source driver 3224 does not refer to the correction magnification register 3225*a*. The correction magnification register 3225*a* records the correction magnification retrieved from the RAM 3226 with the RAM read timing signal. By contrast, the correction magnification parameter 3225*b* is timed to record the correction magnification as described below.

Initially, when the image forming conditions are changed based on the image forming condition adjustment pattern Pe, the correction value adjuster 3225 changes the correction magnification of the correction magnification register 3225*a* during the image forming operation. The correction magnification of the correction magnification register 3225*a* is not directly referred to.

After the correction magnification of the correction magnification register 3225*a* is changed, the set enable signal is asserted. If the HP sensor signal is input and the image gate signal is negated while the set enable signal is asserted, the correction value adjuster 3225 sets the correction magnification of the correction magnification register 3225*a* to the correction magnification parameter 3225*b*. The light source driver 3224 determines the exposure correction intensity with reference to the correction magnification parameter 3225*b*. Since update of the exposure correction intensity is timed with the HP sensor signal outside an image area after the register is updated, undesirable side effects on the images are suppressed.

Thus, the exposure correction intensity is updated when the set enable signal is asserted because the set enable signal asserted indicates detection of update of the correction magnification register 3225*a*. Similarly, the exposure correction intensity is updated when the HP sensor signal is input because the exposure correction data is a difference value starting from the home position. Therefore, if the exposure correction data is an absolute value, the HP sensor signal is rendered unnecessary.

Figure 29:
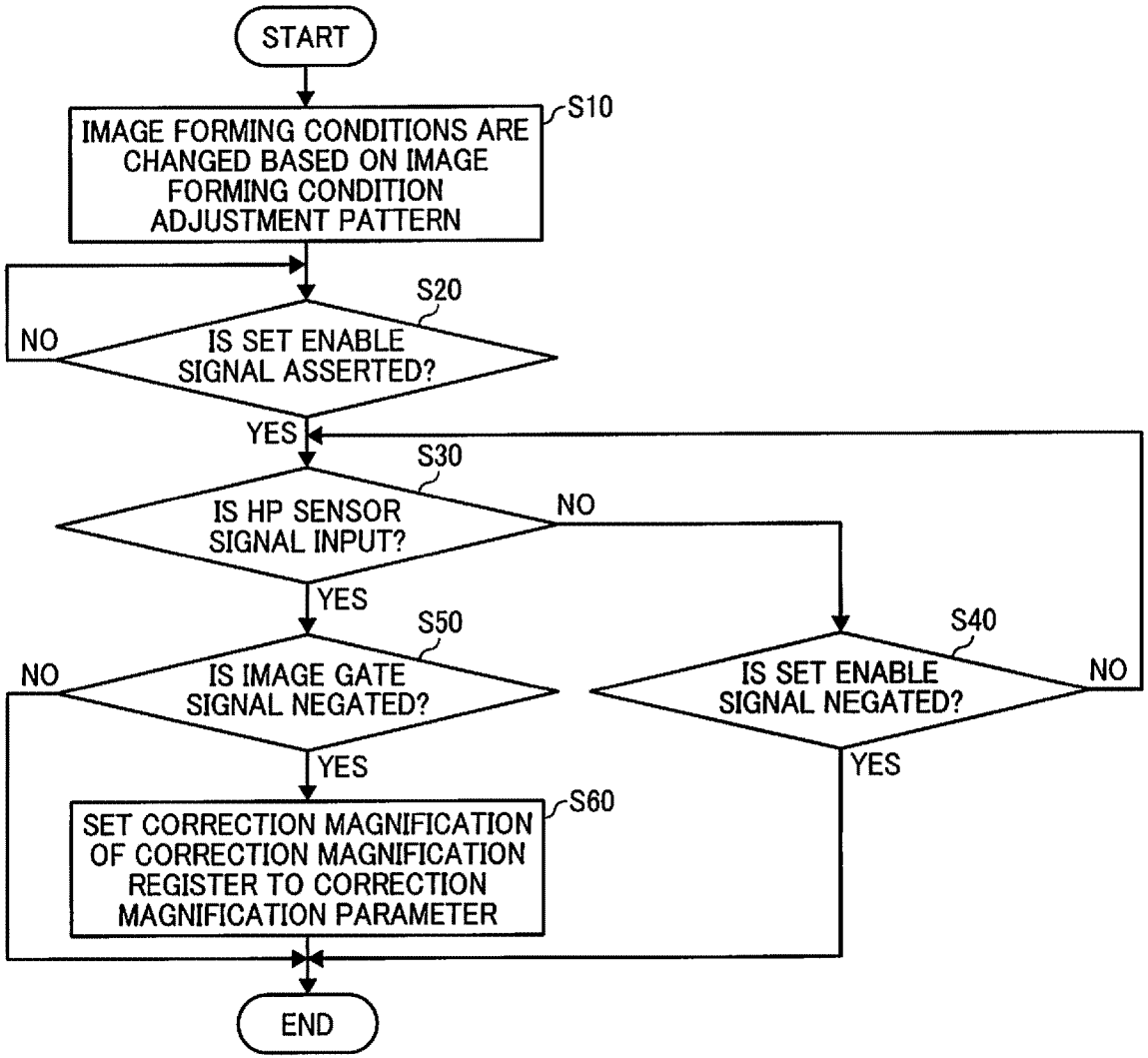
FIG. 29 is a flowchart illustrating a process of setting the correction magnification to a correction magnification parameter, executed by the correction value adjuster, according to the first embodiment.

FIG. 29 is a flowchart illustrating a process of setting the correction magnification to the correction magnification parameter 3225*b*, executed by the correction value adjuster 3225, according to the first embodiment.

The process of FIG. 29 starts when the image forming conditions are changed, for example.

Initially in step S10, the image forming conditions are changed based on the image forming condition adjustment pattern Pe. The correction value adjuster 3225 detects that the correction magnification or the correction cycle is to be changed in association with the change in the image forming conditions.

Subsequently in step S20, the correction value adjuster 3225 determines whether the set enable signal is asserted. If the set enable signal is not asserted (No in S20), the correction value adjuster 3225 waits until the set enable signal is asserted.

By contrast, if the set enable signal is asserted (Yes in S20), then, the correction value adjuster 3225 determines whether the HP sensor signal is input in step S30.

If the correction value adjuster 3225 determines that the HP sensor signal is not input (No in S30), then, the correction value adjuster 3225 determines whether the set enable signal is negated in step S40. That is, the correction value adjuster 3225 determines whether the HP sensor signal is input while the set enable signal is asserted. If the correction value adjuster 3225 determines that the set enable signal is not negated (No in S40), then, the process returns to the step S30. If the correction value adjuster 3225 determines that the set enable signal is neglated (Yes in S40), then, the process of FIG. 29 ends.

If the correction value adjuster 3225 determines that the HP sensor signal is input (Yes in S30), then, the correction value adjuster 3225 determines whether the image gate signal is negated in step S50. If the correction value adjuster 3225 determines that the image gate signal is not negated (No in S50), the process of FIG. 29 ends.

If the correction value adjuster 3225 determines that the image gate signal is negated (Yes in S50), then, the correction value adjuster 3225 sets the correction magnification of the correction magnification register 3225*a* to the correction magnification parameter 3225*b* in step S60.

Thus, update of the correction magnification parameter 3225*b* is timed with the HP sensor signal outside an image area after the register is updated. Accordingly, undesirable side effects on the images are suppressed. Similarly, the correction cycle is adjusted as described above. Accordingly, undesirable side effects on the images are suppressed.

Now, a description is given of a second embodiment of the present disclosure.

In the first embodiment described above, at least one of the cycle and the magnification of the exposure correction is adjusted when the image gate signal is negated. However, if intervals of the HP sensor signals are relatively long, it may rarely happen that the image gate signal is negated while the HP sensor signal is input. That is, the cycle and the magnification of the exposure correction may rarely updated, or may not be frequently updated.

Figure 30:
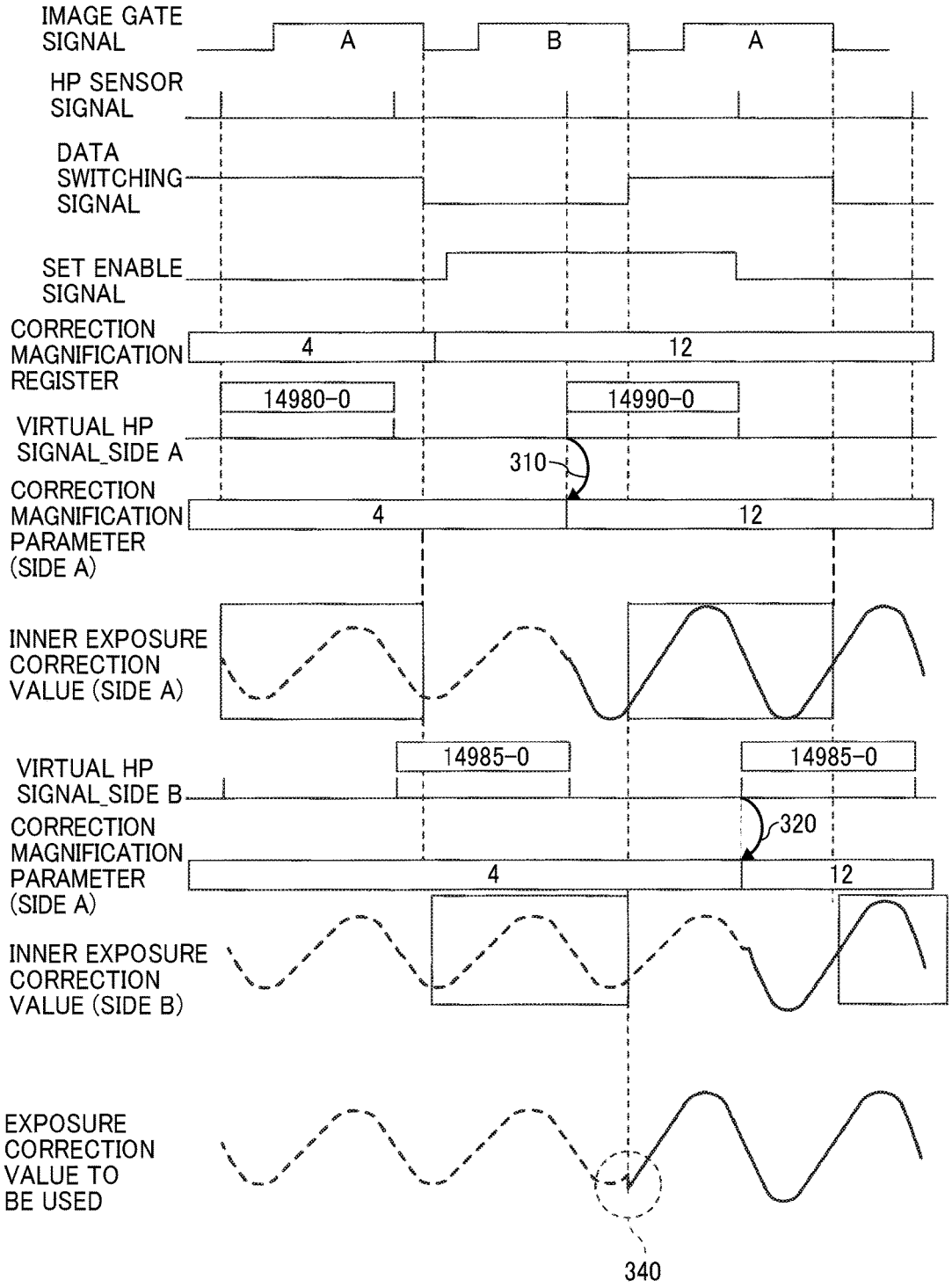
FIG. 30 is a timing chart of exposure correction according to a second embodiment.

Hence, as illustrated in FIG. 30, the correction value adjuster 3225 generates inner exposure correction values in two systems (hereinafter referred to as side A and side B), thereby using the inner exposure correction values while switching between the side A and the side B alternately.

FIG. 30 is a timing chart of exposure correction according to the second embodiment.

A data switching signal of FIG. 30 is a signal that is inverted when the image gate signal is negated immediately after an input of the HP sensor signal. The data switching signal is used to switch between the side A and the side B. A virtual HP signal_side A and a virtual HP signal_side B are virtual HP signals.

In FIG. 30, the inner exposure correction value (side A) is used when the data switching signal is 1. By contrast, the inner exposure correction value (side B) is used when the data switching signal is 0. The virtual HP signal_side A or the virtual HP signal_side B on a side in use for the exposure correction is generated by use of a counter corresponding to a period of time for one rotation of the photoconductor drum 2030. Accordingly, an elapsed time is acknowledged, thereby suppressing a mismatch between a rotational position of the photoconductor drum 2030 and the exposure correction data signal. By contrast, the virtual HP signal_side A or the virtual HP signal_side B on a side not in use for the exposure correction is generated by use of an actual HP signal. Accordingly, frequent mismatch between the actual HP sensor signal and the virtual HP signal internally generated is prevented. That is, with respect to the virtual HP signal_side A, if a counter is deactivated, the HP sensor signal activates the counter to start counting. When the counter counts a given value, the correction value adjuster 3225 outputs the virtual HP signal_side A while the counter is deactivated. Similarly, with respect to the virtual HP signal_side B, if the counter is deactivated, the HP sensor signal activates the counter to start counting. When the counter counts a given value, the correction value adjuster 3225 outputs the virtual HP signal_side B while the counter is deactivated.

Initially, the correction magnification of the correction magnification register 3225*a* is updated. The set enable signal is asserted. The correction value adjuster 3225 determines the exposure correction data (i.e., correction magnification parameter) on the side not in use with reference to the data switching signal. When the virtual HP signal is input, the correction value adjuster 3225 updates the correction magnification parameter, which is an example of the exposure correction parameter, on the side not in use for the exposure correction. As described above in the first embodiment, the correction value adjuster 3225 updates the correction magnification parameter when the virtual HP signal is input because a difference value starting from the home position is input in the exposure correction value. Therefore, if the exposure correction data is an absolute value, input of the virtual HP signal is rendered unnecessary.

For example, the data switching signal is 0 at a time 310. Therefore, the inner exposure correction value (side B) is used. Accordingly, when the virtual HP signal_side A is input, the correction magnification parameter 3225*b* of the inner exposure correction (side A) is updated. At the time 310, the image gate signal is asserted while the inner exposure correction value (side A) is not referred to. Accordingly, there are no side effects on image quality. Similarly, the data switching signal is 1 at a time 320. Therefore, the inner exposure correction value (side A) is used. Accordingly, when the virtual HP signal_side B is input, the correction magnification parameter 3225*b* of the inner exposure correction (side B) is updated.

Thus, two correction magnification parameters 3225*b* are prepared to update one of the two correction magnification parameters 3225*b* on the side not in use. Accordingly, the correction magnification is changed outside the image area, even if the correction magnification parameter 3225*b* is rarely updated.

It is to be noted that a lowest portion of FIG. 30 illustrates "exposure correction value to be used". The exposure correction value to be used includes a step 340 as illustrated in FIG. 30. However, since the step 340 corresponds to a rising edge of the data switching signal, an image is not formed. That is, the step 340 does not affect image quality.

Figure 31:
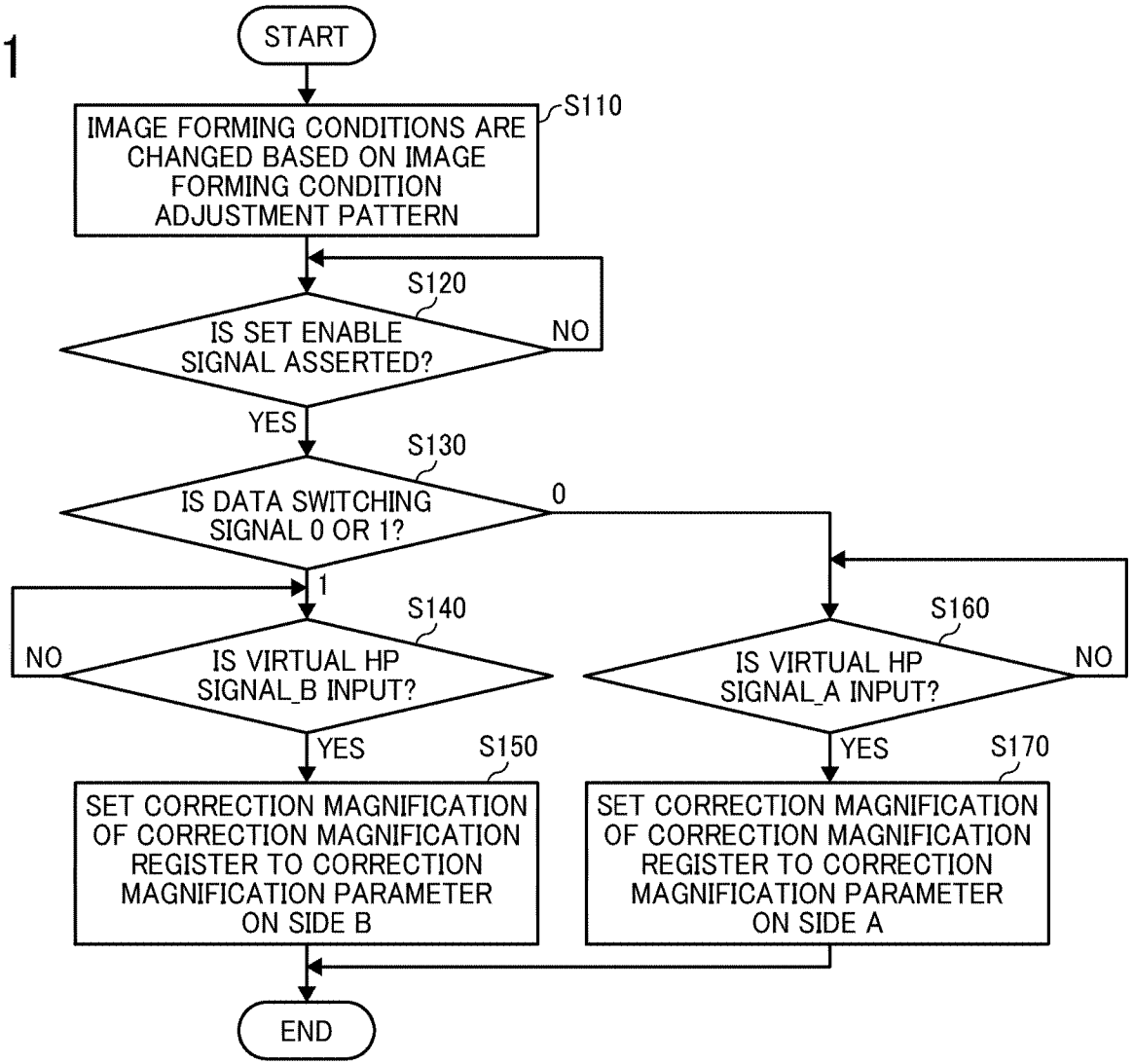
FIG. 31 is a flowchart illustrating a process of setting the correction magnification to the correction magnification parameter, executed by the correction value adjuster, according to the second embodiment.

FIG. 31 is a flowchart illustrating a process of setting the correction magnification to the correction magnification parameter 3225*b*, executed by the correction value adjuster 3225, according to the second embodiment.

The process of FIG. 31 starts when the image forming conditions are changed, for example. Steps S110 and S120 of FIG. 31 are identical to the steps S10 and S20 of FIG. 29, respectively.

If the set enable signal is not asserted (No in S120), the correction value adjuster 3225 waits until the set enable signal is asserted.

By contrast, if the set enable signal is asserted (Yes in S120), the correction value adjuster 3225 determines whether the data switching signal is 0 or 1 in step S130.

If the correction value adjuster 3225 determines that the data switching signal is 1 (1 in S130), then, the correction value adjuster 3225 determines whether the virtual HP signal_side B is input in step S140, because the inner exposure correction value (side A) is used.

If the correction value adjuster 3225 determines that the virtual HP signal_side B is input (Yes in S140), then, the correction value adjuster 3225 sets the correction magnification of the correction magnification register 3225*a* to the correction magnification parameter 3225*b* on side B in step S150. By contrast, if the correction value adjuster 3225 determines that the virtual HP signal_side B is not input (No in S140), then, the correction value adjuster 3225 waits until the virtual HP signal_side B is input.

If the correction value adjuster 3225 determines that the data switching signal is 0 (0 in S130), then, the correction value adjuster 3225 determines whether the virtual HP signal_side A is input in step S160, because the inner exposure correction value (side B) is used.

If the correction value adjuster 3225 determines that the virtual HP signal_side A is input (Yes in S160), then, the correction value adjuster 3225 sets the correction magnification of the correction magnification register 3225*a* to the correction magnification parameter 3225*b* on side A in step S170. By contrast, if the correction value adjuster 3225 determines that the virtual HP signal_side A is not input (No in S160), then, the correction value adjuster 3225 waits until the virtual HP signal_side A is input.

Now, a description is given of some advantages according to the embodiments of the present disclosure.

As described above, the correction magnification parameter 3225*b* is provided separately from the correction magnification register 3225*a*. Accordingly, the exposure correction data is reflected to the optical scanner 2010 at a time different from a time when the exposure correction data is updated. In other words, according to the exposure correction data output of the optical scanner 2010 is adjusted at a time different from a time when the exposure correction data is updated. That is, even if the conditions of operation of the image forming engine change, the exposure for correction is changed while images are not formed. Specifically, the correction value adjuster 3225 updates exposure correction data while images are not formed, or updates one of the two correction magnification parameters 3225*b* that is not referred to, thereby suppressing undesirable side effects on image quality. Accordingly, when the image forming condition adjustment pattern Pe is formed between consecutive images of a print job, that is, between consecutive recording media, changing the conditions of operation of the image forming engine during the print job, the exposure correction value is changed immediately, leaving printing productivity unimpaired.

The present disclosure is not limited to the details of the embodiments described above, and various modifications and improvements are possible.

For example, in the embodiments described above, the exposure correction data is updated after the image forming conditions are updated based on a pattern for adjustment of image forming conditions. Alternatively, the exposure correction data may be updated based on signals from a temperature sensor and a humidity sensor that measure the environment in the image forming apparatus 2000. In such a case, the exposure correction data is prepared corresponding to the temperature and humidity.

In the embodiments described above, the correction value adjuster 3225 is implemented by a hardware circuit, and may be implemented by software.

Periodic variation in density in the sub-scanning direction may be caused by, e.g., the photoconductor drums and the rotators of the image forming engine unit, such as the developing roller and the charging roller.

Each of the structure examples illustrated in, e.g., FIG. 10 is constructed of some functional units to facilitate understanding of processing executed by the image forming apparatus 2000. The embodiments of the present disclosure are not limited by how the processing is divided into processing units or by the unit name. The processing executed by the image forming apparatus 2000 can be divided into further more processing units depending on the content of the processing. In addition, a single processing unit can be further divided into some processing units.

The image forming apparatus 2000 is an apparatus having an image forming function. For example, the image forming apparatus 2000 may be a printer including a color printer, a copier, a facsimile machine, a scanner, a multifunction peripheral (MFP) having at least one of printing, copying, facsimile, scanning, and plotter functions, or the like.

The image forming apparatus 2000 may correct the exposure with an image processing system that communicates with a server. The image forming apparatus 2000 transmits readings of the optical sensors P1 through P5, that is, density information detected by the optical sensors P1 through P5, to the server. Then, the server generates exposure correction data and sends the exposure correction data to the image forming apparatus 2000.

It is to be noted that the correction value adjuster 3225 is an example of an exposure corrector that generates exposure correction data. The virtual HP signal_side A and the virtual HP signal_side 13 are examples of virtual sensor signals. The developing roller 2033 is an example of a developing device that develops a latent image to form an image. The correction value adjuster 3225 included in the information processing apparatus such as a server is an example of a first exposure corrector. The correction value adjuster 3225 included in the image forming apparatus 2000 is an example of a second exposure corrector.

As described above, the image forming apparatus according to the embodiments described above reduces undesirable side effects of exposure correction.

Although the present disclosure makes reference to specific embodiments, it is to be noted that the present disclosure is not limited to the details of the embodiments described above and various modifications and enhancements are possible without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), DSP (digital signal processor), FPGA (field programmable gate array) and conventional circuit components arranged to perform the recited functions.

Any one of the above-described operations may be performed in various other ways, for example, in an order different from the one described above.

Further, any of the above-described devices or units can be implemented as a hardware apparatus, such as a special-purpose circuit or device, or as a hardware/software combination, such as a processor executing a software program.

Further, as described above, any one of the above-described and other methods of the present disclosure may be embodied in the form of a computer program stored in any kind of storage medium. Examples of storage mediums include, but are not limited to, flexible disk, hard disk, optical discs, magneto-optical discs, magnetic tapes, non-volatile memory cards, read only memory (ROM), etc.

Alternatively, any one of the above-described and other methods of the present disclosure may be implemented by an application specific integrated circuit (ASIC), prepared by interconnecting an appropriate network of conventional component circuits or by a combination thereof with one or more conventional general purpose microprocessors and/or signal processors programmed accordingly.

What is claimed is:

1. An image forming apparatus comprising:

a photoconductor rotatable in a direction of rotation;

an optical scanner including a light source, to drive the light source to form a latent image on a surface of the photoconductor;

a developing device to develop the latent image to form an image;

a density detector to detect variation in density of the image in the direction of rotation of the photoconductor; and an exposure corrector to generate exposure correction data for the optical scanner to reduce the variation in density, and adjust output of the optical scanner according to the exposure correction data at a time different from a time when the exposure corrector updates the exposure correction data, wherein the exposure corrector adjusts output of the optical scanner according to the exposure correction data when a sensor signal indicating that the photoconductor returns to a home position is input while a set enable signal indicating an update of the exposure correction data is asserted.

2. The image forming apparatus according to claim 1, wherein, after the exposure corrector updates the exposure correction data during an image forming operation, the exposure corrector adjusts output of the optical scanner according to the exposure correction data when the optical scanner is not engaged in the image forming operation.

3. The image forming apparatus according to claim 1, wherein the exposure correction data is periodic data changing as the photoconductor rotates, and wherein the exposure corrector adjusts output of the optical scanner according to one of an amplitude, a cycle, an initial value, and a resolution of the periodic data at a time different from the time when the exposure corrector updates the exposure correction data.

4. The image forming apparatus according to claim 1, wherein the exposure corrector refers to an image gate signal indicating whether the optical scanner is engaged in the image forming operation to form the latent image, and wherein, when the optical scanner is engaged in the image forming operation, the exposure corrector does not adjust output of the optical scanner according to the exposure correction data even though the exposure corrector updates the exposure correction data.

5. The image forming apparatus according to claim 1, wherein the exposure corrector is configured to:

generate a plurality of exposure correction parameters from the exposure correction data;

be timed to switch between the plurality of exposure correction parameters such that the optical scanner uses one of the plurality of exposure correction parameters; and reflect the exposure correction data to an unused exposure correction parameter not used by the optical scanner, out of the plurality of exposure correction parameters.

6. The image forming apparatus according to claim 5, wherein, when an image gate signal indicating whether the optical scanner is engaged in the image forming operation to form the latent image is negated immediately after a sensor signal indicating that the photoconductor returns to a home position is input, the exposure corrector generates a data switching signal indicating which one of a plurality of exposure correction data the optical scanner uses, and wherein the exposure corrector refers to the data switching signal to reflect the exposure correction data to the unused exposure correction parameter.

7. The image forming apparatus according to claim 6, wherein, after the exposure corrector updates the exposure correction data, the exposure corrector refers to the data switching signal to determine the unused exposure correction parameter, and wherein the exposure corrector reflects the exposure correction data to the unused exposure correction parameter when the sensor signal is input.

8. The image forming apparatus according to claim 7, wherein the exposure corrector is configured to:

generate a virtual sensor signal indicating that the photoconductor returns to the home position with a counter, the virtual sensor signal corresponding to each of the plurality of exposure correction parameters;

output the virtual sensor signal corresponding to an in-use exposure correction parameter used by the optical scanner, out of the plurality of exposure correction parameters, with the counter counting a given value; and output the virtual sensor signal corresponding to the unused exposure correction parameter by an input of the sensor signal.

9. The image forming apparatus according to claim 1, wherein the density detector reads a pattern for adjustment of image forming conditions between images formed by the optical scanner, and wherein the exposure corrector generates the exposure correction data for a rotation period of the photoconductor based on readings of the density detector.

10. An optical scanning controller for controlling an optical scanner, the optical scanning controller comprising:

circuitry configured to generate exposure correction data for the optical scanner to reduce variation in density of an image, and adjust output of the optical scanner according to the exposure correction data at a time different from a time when the exposure corrector updates the exposure correction data, wherein the circuitry adjusts output of the optical scanner according to the exposure correction data when a sensor signal indicating that the photoconductor returns to a home position is input while a set enable signal indicating an update of the exposure correction data is asserted.

11. A method for correcting exposure in an image forming apparatus, the image forming apparatus including a photoconductor and an optical scanner, the method comprising:

detecting variation in density of an image in a direction of rotation of the photoconductor;

generating exposure correction data for the optical scanner to reduce the variation in density; and adjusting output of the optical scanner according to the exposure correction data at a time different from a time to update the exposure correction data and according to the exposure correction data when a sensor signal indicating that the photoconductor returns to a home position is input while a set enable signal indicating an update of the exposure correction data is asserted.

12. The method according to claim 11, further comprising, after the updating the exposure correction data during an image forming operation, adjusting output of the optical scanner according to the exposure correction data when the optical scanner is not engaged in the image forming operation.

13. The method according to claim 11, wherein the adjusting of the output of the optical scanner is performed according to one of an amplitude, a cycle, an initial value, and a resolution of the periodic data at a time different from the time when the exposure corrector updates the exposure correction data.

14. The method according to claim 12, further comprising referring to an image gate signal indicating whether the optical scanner is engaged in the image forming operation to form a latent image, and not adjusting output of the optical scanner according to the exposure correction data when the optical scanner is engaged in the image forming operation even though the exposure corrector updates the exposure correction data.

15. The method according to claim 11, further comprising:

generating a plurality of exposure correction parameters from the exposure correction data;

switching between the plurality of exposure correction parameters such that the optical scanner uses one of the plurality of exposure correction parameters; and reflecting the exposure correction data to an unused exposure correction parameter not used by the optical scanner, out of the plurality of exposure correction parameters.

16. The method according to claim 15, wherein, when an image gate signal indicating whether the optical scanner is engaged in the image forming operation to form the latent image is negated immediately after a sensor signal indicating that the photoconductor returns to a home position is input, generating a data switching signal indicating which one of a plurality of exposure correction data the optical scanner uses, and referring to the data switching signal to reflect the exposure correction data to the unused exposure correction parameter.

17. The method according to claim 16, wherein, after the exposure corrector updates the exposure correction data, referring to the data switching signal to determine the unused exposure correction parameter, and reflecting the exposure correction data to the unused exposure correction parameter when the sensor signal is input.

18. The method according to claim 17, further comprising:

generating a virtual sensor signal indicating that the photoconductor returns to the home position with a counter, the virtual sensor signal corresponding to each of the plurality of exposure correction parameters;

outputting the virtual sensor signal corresponding to an in-use exposure correction parameter used by the optical scanner, out of the plurality of exposure correction parameters, with the counter counting a given value; and outputting the virtual sensor signal corresponding to the unused exposure correction parameter by an input of the sensor signal.

* * * * *